US008231708B2

(12) United States Patent
Yanagisawa et al.

(10) Patent No.: US 8,231,708 B2
(45) Date of Patent: Jul. 31, 2012

(54) METHOD OF PRODUCTION, STORAGE AND TRANSPORTATION FOR GAS HYDRATE

(75) Inventors: Naoki Yanagisawa, Tokyo (JP); Seiichi Takanashi, Tokyo (JP); Tamehisa Yamaguchi, Tokyo (JP); Takahiro Yamazaki, Tokyo (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 212 days.

(21) Appl. No.: 12/449,620

(22) PCT Filed: Feb. 19, 2007

(86) PCT No.: PCT/JP2007/052985

§ 371 (c)(1),
(2), (4) Date: Aug. 18, 2009

(87) PCT Pub. No.: WO2008/102427

PCT Pub. Date: Aug. 28, 2008

(65) Prior Publication Data

US 2010/0083568 A1 Apr. 8, 2010

(51) Int. Cl.
*B01D 53/80* (2006.01)

(52) U.S. Cl. ..... 95/36; 95/153; 585/15

(58) Field of Classification Search ..... 95/153, 95/237, 36–37; 585/15; 423/245.1; 44/500
See application file for complete search history.

(56) References Cited

FOREIGN PATENT DOCUMENTS

| | | | |
|---|---|---|---|
| JP | 2001-280592 A | | 10/2001 |
| JP | 2002-220353 | * | 8/2002 |
| JP | 2003-171678 | * | 6/2003 |
| JP | 2003-171678 A | | 6/2003 |
| JP | 2004-131272 | | 4/2004 |
| JP | 2004-131272 A | | 4/2004 |
| JP | 2006-153120 | * | 11/2004 |
| JP | 2006-153120 | * | 6/2006 |
| JP | 2006-153120 A | | 6/2006 |
| JP | 2007-077253 | | 3/2007 |
| JP | 2007-077253 A | | 3/2007 |

* cited by examiner

*Primary Examiner* — Duane Smith
*Assistant Examiner* — Ives Wu
(74) *Attorney, Agent, or Firm* — Kubovcik & Kubovcik

(57) ABSTRACT

Pellet damaging is prevented at the time of pellet charging into a storage tank. There is provided a method of storing a gas hydrate in which pellets obtained by compression molding of powdery gas hydrate are conveyed into a storage tank by the use of a slurry liquor, which method includes pouring a liquid for impact absorption in advance into the storage tank so that the impact on the pellets charged in the storage tank is absorbed by the liquid for impact absorption.

4 Claims, 19 Drawing Sheets m
15
126
16
B
B
O
O
O
※
※
※
132
132
132
135
135
131
131
131
H(H')
m'
n'
127
p
130
130
130
128
146
146
147
147
148
136
19
S''

METHOD OF PRODUCTION, STORAGE AND TRANSPORTATION FOR GAS HYDRATE

This application is a 371 of international application PCT/JP2007/052985, filed Feb. 19, 2007, which is incorporated herein by reference.

TECHNICAL FIELD

The present invention relates to a method for producing, storing, and transporting gas hydrate, and more specifically to a method for producing gas hydrate through molding a powdery gas hydrate into pellets thereof using a granulation apparatus in a non-reacted gas and through carrying out the pellets to a storage tank under atmospheric pressure, to a method for storing the gas hydrate by storing said pellets in the storage tank, and to a method for transporting the gas hydrate in the storage tank.

BACKGROUND ART

As a method for transporting natural gas by converting the natural gas into a hydrate thereof, there has been proposed a transporting method in which the natural gas is converted into the hydrate thereof in production plant adjacent to the mining site, which hydrated natural gas, as the product, is put into a product storage container, and the product storage container is used as the transportation container to load on a transportation means such as, for example, a transport ship and to transport the hydrated natural gas to a consuming region, then said product storage container is used as the raw material storage container at a re-gasification plant adjacent to the consuming region, which allows the decomposition of dehydrated natural gas (for example, refer to Patent Document 1).

On transporting natural gas after being hydrated, however, the hydrate of natural gas, or gas hydrate, has a low filling rate in as powder state, (filling rate of 0.4, for example), and gives poor handling performance. Consequently, there are necessities to increase the filling rate and to increase the handling performance.

When a powdery gas hydrate is molded into pellets by using a granulation apparatus, the filling rate increases (filling rate of 0.56, for example). Since, however, the granulation apparatus is filled with a portion of non-reacted gas in the gas hydrate production apparatus, when the pellets formed by the granulation apparatus are carried out to a storage tank set under atmospheric pressure, the high-pressure non-reacted gas enters the storage tank together with the pellets. Thus, the storage tank is required to be fabricated to endure high pressure.

The storage tank expects the one having large capacity, such as a tank having 60 to 70 m in diameter and 20 to 30 m in height. When such large capacity storage tank is designed to pressure-resistant one, the cost becomes excessive, which causes loss of advantages of producing, storing, and transporting the gas hydrate of natural gas and water. Therefore, further technology innovation is required in order to store the pellets molded by a granulation apparatus in a storage tank under atmospheric pressure without accompanying high pressure non-reacted gas.

In addition, on storing pellets, when the pellets are charged from the upper part of the storage tank, they may collide with the bottom of the storage tank or with other pellets accumulated in the tank, which may break or disrupt pellets. Break or disruption of pellets deteriorates the self-retaining effect, and likely induces gasification. If pellet debris gets mixed into the slurry mother liquid, the slurry mother liquid becomes sherbet state, which makes the adjustment of pellet mixing rate difficult on transporting the pellets. When the pellets are discharged from a storage tank for loading on a ship, the carry-out of the pellets may become difficult as the pellets in the storage tank are consolidated.

Patent Document 1: Japanese Patent Application Kokai Publication No. 2001-280592

DISCLOSURE OF THE INVENTION

Problems to be Solved by the Invention

The present invention has been implemented in order to solve the above problems, and an object of the present invention is to provide a method for producing gas hydrate by discharging pellets in a non-reacted gas to a storage tank set under atmospheric pressure without accompanying the non-reacted gas. Another object of the present invention is to provide a method for storing gas hydrate, preventing damage to pellets on charging the pellets to the storage tank. Further object of the present invention is to provide a method for transporting gas hydrate, smoothly discharging the pellets on discharging them from the storage tank.

Means to Solve the Problems

To achieve the above objects, the present invention has the structure as follows.

The invention in a first embodiment is a method for producing gas hydrate through molding a powdery gas hydrate into pellets thereof using a granulation apparatus in a non-reacted gas, then the pellets being carried out to a storage tank under atmospheric pressure, the method having the steps of: charging the non-reacted gas into a slurry tank; charging the pellets into the slurry tank filled with the non-reacted gas; charging a slurry mother liquid into the slurry tank holding the charged pellets to return the non-reacted gas in the slurry tank to the granulation apparatus; manipulating a valve of a slurry transfer pipe attached to the slurry tank to release internal pressure of the slurry tank; and charging the depressurized non-reacted gas into the slurry tank after releasing the internal pressure, pushing the pellets in the slurry tank into the slurry transfer pipe together with the slurry mother liquid, and simultaneously supplying the slurry mother liquid to said slurry tank to dilute the concentration of the slurry.

The invention in a second embodiment is a method for producing gas hydrate through molding a powdery gas hydrate into pellets thereof using a granulation apparatus in a non-reacting gas, which pellets then being carried out to a storage tank under atmospheric pressure, the method having the steps of: charging the pellets into a slurry mother liquid in the non-reacted gas to form a slurry; charging the slurry into a slurry tank to return the non-reacted gas in the slurry tank to the granulation apparatus; manipulating a valve of a slurry transfer pipe attached to the slurry tank to release internal pressure of the slurry tank; and charging the depressurized non-reacted gas into the slurry tank after releasing the internal pressure, pushing the pellet in the slurry tank into the slurry transfer pipe together with the slurry mother liquid, and simultaneously supplying the slurry mother liquid to the slurry tank to dilute the concentration of the slurry.

The invention in a third embodiment is a method for storing gas hydrate through carrying pellets formed by compression molding of a powdery gas hydrate into a storage tank through the use of a slurry mother liquid, the method having the step of charging a shock-absorbing liquid in advance into the storage tank and absorbing an shock on the pellet being charged to the storage tank by the shock-absorbing liquid.

The invention in a fourth embodiment is the method according to the third embodiment, wherein the level of the shock-absorbing liquid is maintained to a given height.

The invention in a fifth embodiment is the method according to the third embodiment, further having the step of locating pluralities of slurry-charging nozzles at the upper part of the storage tank to eject the slurry mother liquid which contains pellets therethrough in sequential order beginning from a specified nozzle.

The invention in a sixth embodiment is the method according to the third embodiment, further having the step of ejecting the slurry mother liquid which contains the pellets, in a spiral pattern, from a freely rotatable slurry-charging nozzle positioned at the upper part of the storage tank.

The invention in a seventh embodiment is the method for transporting gas hydrate having the steps of: charging a slurry mother liquid into the slurry storage tank, on carrying out pellets from the storage tank, to bring the pellets into a flowing state; simultaneously ejecting the slurry mother liquid against a pellet suction opening at the bottom part of the storage tank to separate the lump of pellets clogging the pellet suction opening; discharging the separated pellets through the pellet suction opening together with the slurry mother liquid; and removing excess slurry mother liquid in the step of the discharge of the pellets to adjust the concentration of the slurry.

The invention in an eighth embodiment is the method according to the seventh embodiment, wherein kerosene or gas oil is used as a liquid for separating and discharging the pellets.

Effect of the Invention

As described above, the invention in the first embodiment is a method for carrying out the gas hydrate through molding a powdery gas hydrate into pellets thereof using a granulation apparatus in a non-reacted gas, which pellets then being carried out to a storage tank under atmospheric pressure, composed of the steps of: charging the non-reacted gas into a slurry tank; charging the pellets into the slurry tank filled with the non-reacted gas; charging a slurry mother liquid into the slurry tank holding the charged pellets to return the non-reacted gas in the slurry tank to the granulation apparatus; manipulating a valve of a slurry transfer pipe attached to the slurry tank to release the internal pressure of the slurry tank; and charging the depressurized non-reacted gas into the slurry tank after releasing the internal pressure, pushing the pellets in the slurry tank into the slurry transfer pipe together with the slurry mother liquid, and simultaneously supplying the slurry mother liquid to the slurry tank to dilute the concentration of the slurry. Consequently, the pellets in the non-reacted gas can be smoothly carried out to a storage tank set under atmospheric pressure, without accompanying high pressure non-reacted gas. As a result, even when a large capacity tank, such as that having 60 to 70 m in diameter and 20 to 30 m in height, is constructed, there is no need of pressure-resistant design and thus the cost can be significantly suppressed.

The invention in the second embodiment is a method for carrying out gas hydrate through molding a powdery gas hydrate into pellets thereof using a granulation apparatus in a non-reacted gas, which pellets then being carried out to a storage tank under atmospheric pressure, composed of the steps of: charging the pellets to a slurry mother liquid into the non-reacted gas to form a slurry; charging the slurry into a slurry tank to return the non-reacted gas in the slurry tank to the granulation apparatus; manipulating a valve of a slurry transfer pipe attached to the slurry tank to release the internal pressure of the slurry tank; and charging the depressurized non-reacted gas into the slurry tank after releasing the internal pressure, pushing the pellets in the slurry tank into the slurry transfer pipe together with the slurry mother liquid, and simultaneously supplying the slurry mother liquid to the slurry tank to dilute the concentration of the slurry. Consequently, in addition to the effect of the present invention in the first embodiment, the pellets which are formed in a slurry state in the granulation apparatus can be depressurized in the slurry tank, followed by being smoothly carried out to a storage tank under atmospheric pressure.

The invention in the third embodiment is a method for carrying in gas hydrate through carrying the pellets formed by compression molding of a powdery gas hydrate to a storage tank through the use of a slurry mother liquid, composed of the step of charging a shock-absorbing liquid in advance into the storage tank and thus absorbing a shock on the pellets being charged to the storage tank by the shock-absorbing liquid. Consequently, the shock on charging the pellets into the storage tank is significantly decreased, which can prevent damage and disruption of pellets. As a result, gasification of pellets caused by damage and disruption can be suppressed. In addition, since the mixing of pellet debris into the slurry mother liquid becomes less, the filling rate of pellets can be accurately adjusted during the transfer of the pellets.

The invention in the fourth embodiment maintains the level of the shock-absorbing liquid to a specified height. Consequently, in addition of the effect of the invention in the third embodiment, the pellets can be always charged under the same condition.

The invention in the fifth embodiment locates pluralities of slurry-charging nozzles at the upper part of the storage tank and ejects a slurry mother liquid which contains pellets therethrough in sequential order beginning from a specified nozzle. Consequently, the pellets can be accumulated almost uniformly in the storage tank.

The invention in the sixth embodiment ejects the slurry mother liquid which contains the pellets, in a spiral pattern, from a freely rotatable slurry-charging nozzle positioned at the upper part of the storage tank. Consequently, similar to the invention described in the fifth embodiment, the pellets can be accumulated almost uniformly in the storage tank.

On the other hand, according to the invention in the seventh embodiment, a slurry mother liquid is charged into the slurry storage tank, on carrying out the pellets from the storage tank, to bring the pellets into a flowing state, and simultaneously the slurry mother liquid is ejected against a pellet suction opening at the bottom part of the storage tank to separate a lump of pellets clogging the pellet suction opening, and then the separated pellets are discharged through the pellet suction opening together with the slurry mother liquid, and excess slurry mother liquid is removed in the step of the discharge of the pellets to adjust the concentration of the slurry. Consequently, the pellets in the storage tank can be smoothly and promptly discharged.

Figure 1:
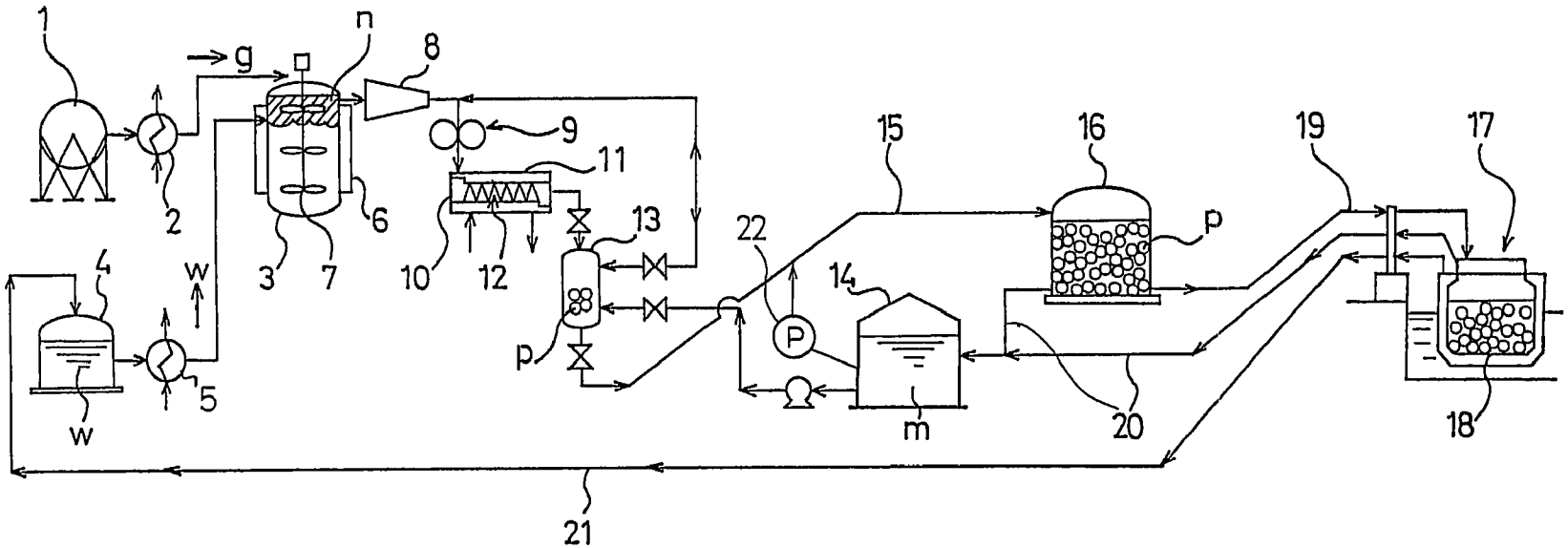
FIG. 1 shows a rough structure of production, storage, and transportation system of gas hydrate according to the present invention.

DESCRIPTION OF THE REFERENCE SYMBOLS n: powdery gas hydrate
9: granulation apparatus
p: pellet
16: storage tank
13: slurry tank
m: slurry mother liquid
B8: valve of slurry transfer pipe
15: slurry transfer pipe

BEST MODE FOR CARRYING OUT THE INVENTION

The embodiments of the present invention are described below referring to the drawings.

(1) First, the description is given about the production, storage, and transportation system of gas hydrate according to the present invention.

As shown in FIG. 1, the raw material gas (such as natural gas) in a spherical tank 1 is increased in the pressure to a specified level (for example 5.4 MPa, preferably from 5 to 7 MPa) by a pressurizing apparatus (not shown), and is cooled to a specified temperature (for example 3° C., preferably from 3° C. to 10° C.) by a cooler 2, and then is charged into a gas hydrate production apparatus 3. The water (such as plain water) w in a water storage tank 4 is cooled to a specified temperature (for example 3° C., preferably from 3° C. to 10° C.) by a cooler 5, and then is supplied to the gas hydrate production apparatus 3.

The natural gas g supplied to the gas hydrate production apparatus 3 carries out hydration reaction with the water w to produce natural gas hydrate n (hereinafter referred to as the "gas hydrate"). The heat of formation generated on producing the gas hydrate is removed by a cooling jacket 6 located outside a gas hydrate production tank. The gas hydrate production tank internals are agitated by an agitator 7. The gas hydrate n is charged into a dehydrator, for example a dehydrator 8 of screw-press type, together with the non-reacted water. The gas hydrate n dewatered by the dehydrator 8 is molded into a solid having a shape and a size suitable for transportation and storage, (hereinafter referred to as the "pellets") by a pelletizer 9, (hereinafter referred to as the "granulation apparatus").

The shape of pellets includes spherical shape and convex lens shape. The size of pellets is preferably about 20 mm in diameter or in diameter of inscribed circle, (hereinafter referred to simply as the "diameter"). However, the diameter is not specifically limited to the range, and for example, about 10 mm to 100 mm can be applied. Although the pellets may have the same size as each other, different pellet diameters can further increase the filling rate. In that regard, it is preferred that the large pellet has a diameter of about 20 to 100 mm, and that the small pellet has a diameter of about 10 to 40 mm.

The pellets p formed by the granulation apparatus 9 are cooled to a specified temperature (for example, ranging from −15° C. to −30° C.) by a cooler 10, for example the cooler 10 of screw-conveyer type, composed of a horizontal casing 11 provided with a cooling jacket, and a screw shaft 12 equipped with screw blades, in the casing 11. After that, the pellets p are charged into a slurry tank 13 for depressurizing. The pellets p in the slurry tank 13 are slurryed by a slurry mother liquid m supplied from a slurry liquid storage tank 14, which slurry is then transferred to a storage tank 16 via a first slurry transfer pipe 15. The slurry mother liquid m which transferred the pellets p returns to the slurry mother liquid storage tank 14 via a slurry mother liquid-returning pipe 20, and only the pellets p are stored in the storage tank 16. A preferred slurry liquid is, for example, kerosene or gas oil.

When the pellets p in the storage tank 16 are transferred to a transport ship 17, the pellets p in the storage tank 16 are again slurried by the slurry mother liquid m, and then are transferred to a hold 18 of the transport ship 17 via a second slurry transfer pipe 19. The slurry mother liquid m after the transfer is returned to the slurry mother liquid storage tank 14 via the slurry mother liquid-returning pipe 20. On receiving the pellets, the transport ship 17 returns the ballast water, or the water (plain water) generated by thermal decomposition of gas hydrate, to the water storage tank 4 via a clear water-returning pipe 21.

(2) Next, the description will be given about the pellet carrying-out apparatus which carries out pellets from the granulation apparatus to the storage tank set under atmospheric pressure.

Figure 2:
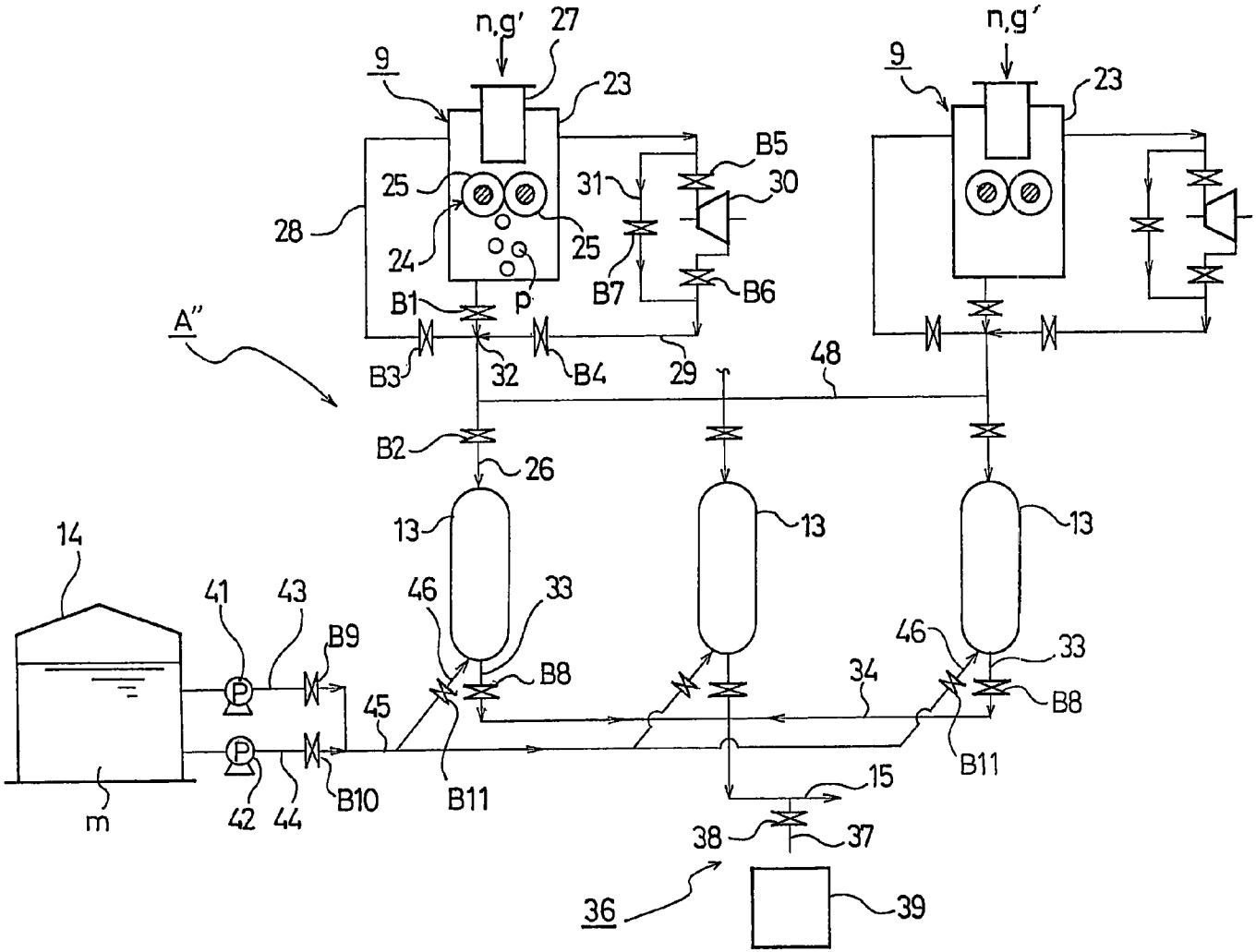
FIG. 2 shows a rough structure of the gas hydrate carrying-out apparatus.

The pellet carrying-out apparatus is structured normally by pluralities of groups, though the structure depends on the scale of the gas hydrate production apparatus 3. Nevertheless, for convenience of explanation, a single group is adopted in the description. As shown in FIG. 2, the group A" is composed of pluralities of (for example, three) granulation apparatuses 9 and the same number of slurry tanks 13. In this case, valves B 8 and valves B 11, attached near to the respective three slurry tanks 13 are manipulated in sequence for the respective tanks 13 to charge the pellets continuously into the storage tank 16. The granulation apparatus 9 is composed of a pressure vessel 23 and a granulator 24 installed in the pressure vessel 23. Although the granulator 24 is not specifically limited, a preferred one is, for example, a type of briquetting roll having pellet-forming concavities (not shown) on the peripheral surface of a pair of rolls 25.

The pressure vessel 23 is connected to the slurry tank 23 via a pellet supply pipe 26. The pressure vessel 23 has a gas hydrate introducing pipe 27 which introduces the powdery gas hydrate n, a gas-returning pipe 28, and a low pressure gas supply pipe 29. The apical part of each of the pipes 28 and 29 connects the pellet supply pipe 26. The gas-returning pipe 28 has a third valve B3, and the low pressure gas supply pipe 29 has an expansion turbine type pressure reducer 30 and a fourth valve B4. Furthermore, the pressure reducer 30 has a fifth valve B5 at the upstream side, and a sixth valve B6 at the downstream side. In addition, the low-pressure gas supply pipe 29 has a bypass pipe 31 which bypasses the pressure reducer 30, and two valves B5 and B6. The bypass pipe 31 has a seventh valve B7.

On the pellet supply pipe 26, there are positioned a first valve B1 at the upstream side of and a second valve B2 at the downstream side of a confluence 32 joining the gas-returning pipe 28 with the low-pressure gas supply pipe 29. The slurry tank 13 has a slurry-discharging pipe 33 having an eighth valve B8 at the bottom part thereof. The slurry-discharging pipes 33 are connected each other by a common pipe 34. Furthermore, the slurry transfer pipe 15 is connected to the common pipe 34. The slurry transfer pipe 15 has a slurry concentration measuring device 36 connected thereto. The slurry concentration measuring device 36 is structured by a sampling pipe 37 provided with a valve and connected to the slurry transfer pipe 15, and a sample container 39. By opening/closing a valve 38 of the sampling pipe 37, the slurry s" in which pellets p is mixed in with the slurry mother liquid m is extracted into the sample container 39, from which the pellet content is determined.

The Pellet content E can be determined by the following formula.

$$E=(X-Y)\times 100/X$$

where, X is the slurry extraction amount, and Y is the amount of slurry mother liquid left after removing the amount of pellets from the slurry extraction amount.

Based on the pellet content, a low-pressure pump 42 is controlled so that the concentration of slurry s" becomes a specified value (for example, about 30%). Although the procedure can be done manually, an automatic operation is preferred. The reason to adjust the concentration of slurry s" to be about 30%, preferably to be an approximate range from 20 to 35%, is that the slurry flowability is deteriorated outside the range.

As shown in FIG. 2, the slurry mother liquid storage tank 14 has a high-pressure pump 41 and a low-pressure pump 42, and the slurry mother liquid m in the slurry mother liquid storage tank 14 is supplied to the slurry tank 13. That is, pipes 43 and 44 of the high-pressure pump 41 and the low-pressure pump 42, respectively, are joined together to become a single slurry mother liquid supply pipe 45. Branch pipes 46 branched from the slurry mother liquid supply pipe 45 are connected to each of the slurry tanks 13.

These branch pipes 46 have the eleventh valves B11, and are attached to near the inlet of the slurry-discharging pipes 33. The pipe 43 of the high-pressure pump 41 has a ninth valve B9, and the pipe 44 of the low-pressure pump 42 has a tenth valve B10. The slurry tanks 13 are connected each other by a connection pipe 48. The connection pipe 48 is located between the confluence 32 and the second valve B2.

(3) Next, the storage tank will be described.

Figure 3:
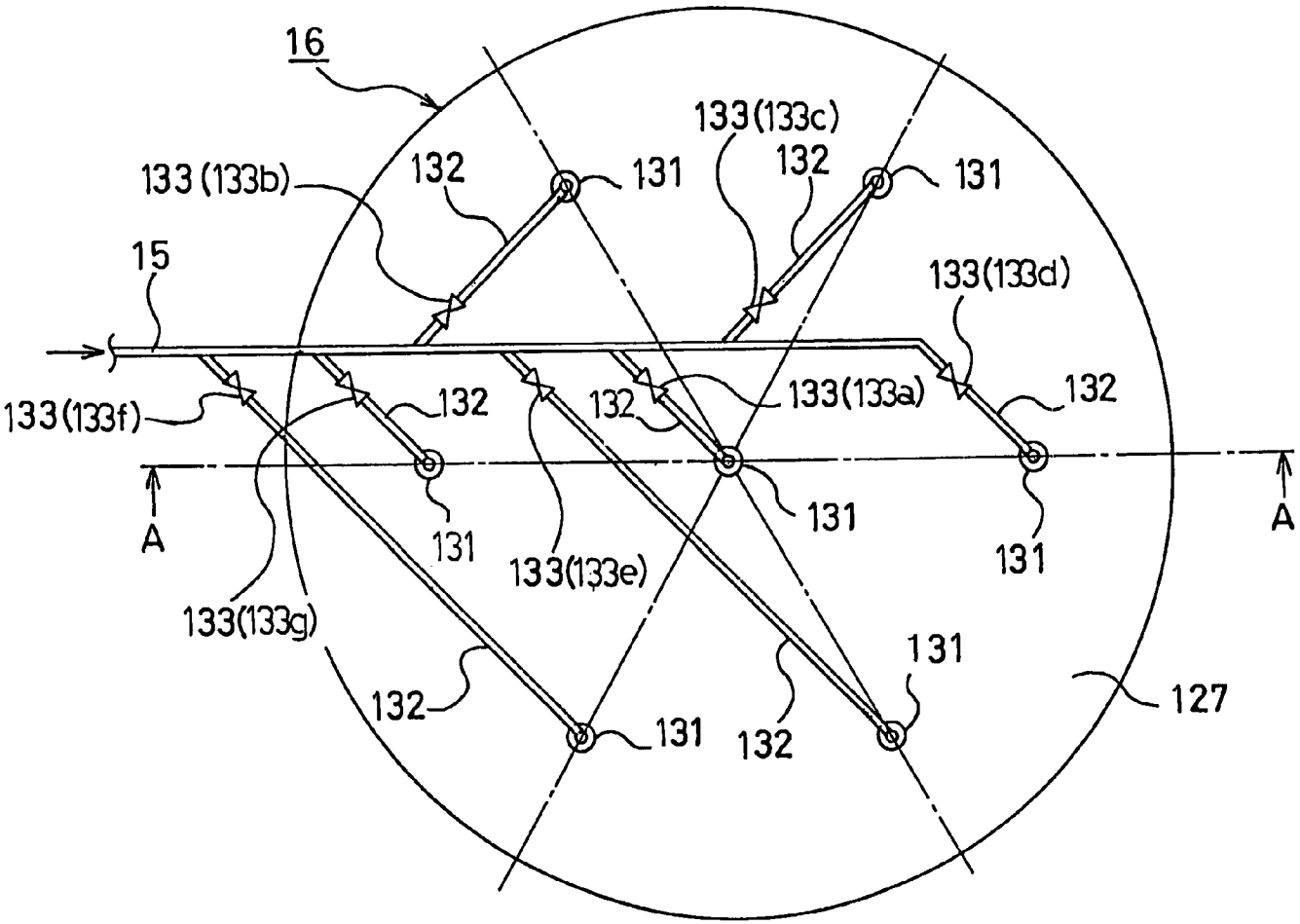
FIG. 3 shows a plan view of the storage tank.
Figure 4:
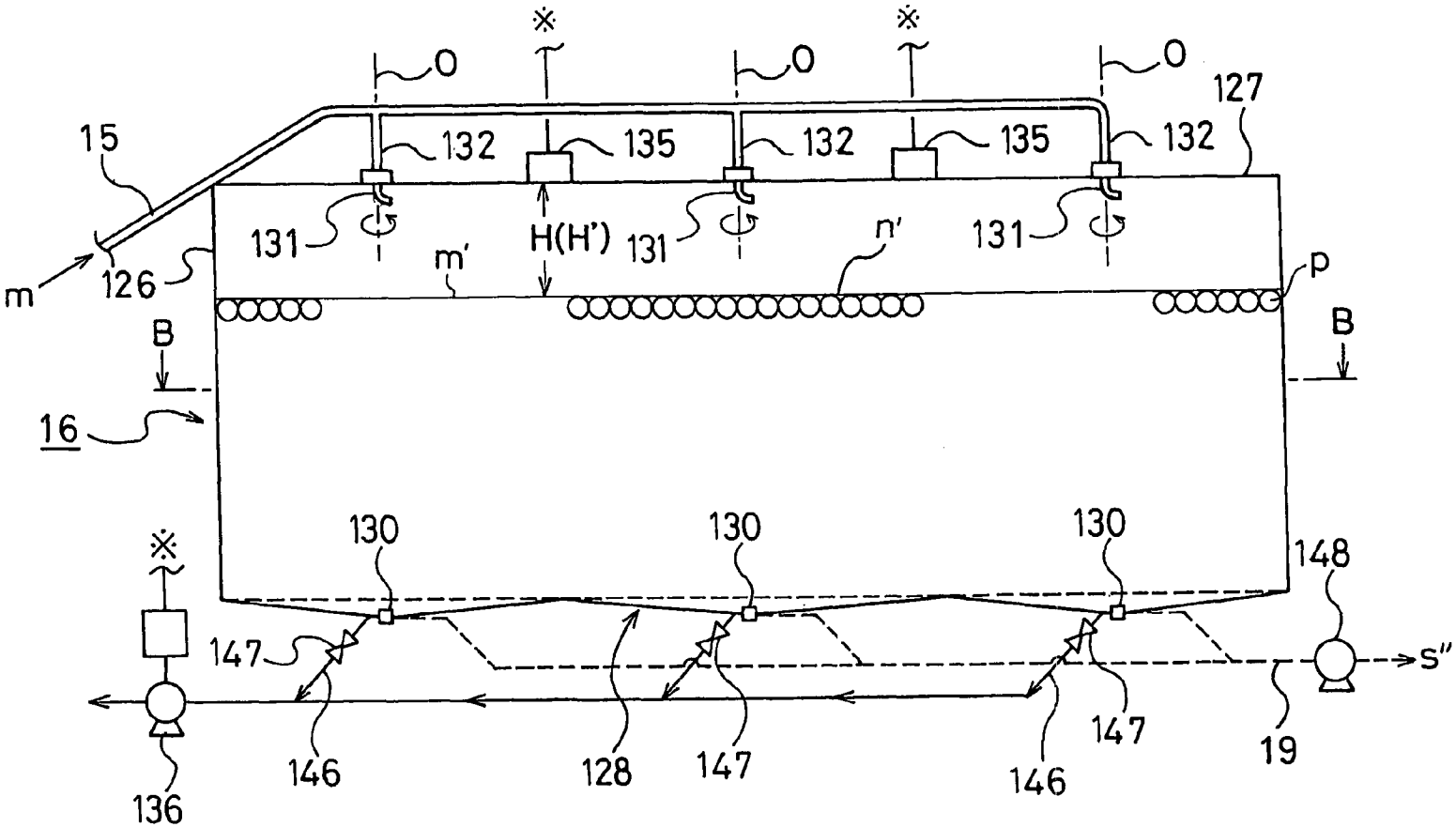
FIG. 4 shows a cross-sectional view of FIG. 3 along the line A-A.
Figure 5:
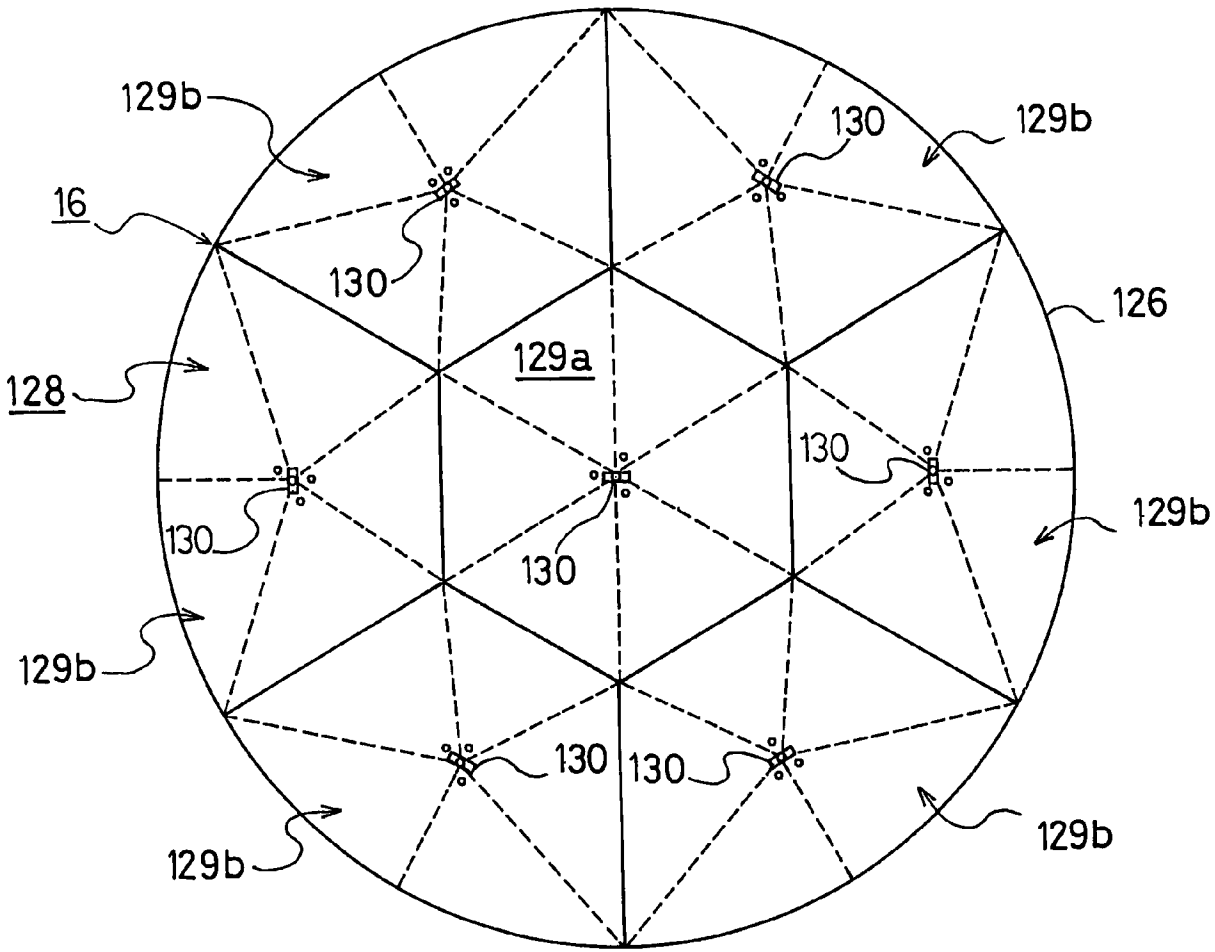
FIG. 5 shows a cross-sectional view of FIG. 3 along the line B-B.

As shown in FIGS. 3 to 5, the storage tank 16 has a cylindrical shell part 126, a circular top plate 127, and a circular bottom face 128. As shown in FIG. 5, the bottom face 128 is structured by a bottom part 129*a* in hexagonal pyramid shape, and six bottom parts 129*b* in tetragonal pyramid shape positioned at each side of the bottom part 129*a*. At the apical parts of each bottom part 129*a* and 129*b*, the jet pumps (ejectors) 130 are each located as the pellet discharging means. As shown in FIG. 4, the storage tank 16 has pluralities of slurry-charging nozzles 131 at the top plate 127 and these slurry-charging nozzles 131 are positioned so as to each face jet pumps 130.

The slurry-charging nozzle 131 is mounted on the top plate 127 in free rotational mode. The slurry-charging nozzle 131 is formed in an elbow shape, and has a structure allowing horizontal turning in 360° centering on the vertical axis O. The elbow-shape slurry-charging nozzle 131 curves at the apical parts in the circumferential direction, and is automatically rotated by a reaction force by which the slurry s is ejected".

Each of the branch pipes 132 branched from the slurry transfer pipe 15 is connected to these slurry-charging nozzles 131. As shown in FIG. 3, each of the branch pipes 132 has a valve 133. In addition, to the top plate 127 of the storage tank 16, one or more distance-measuring device 135 is mounted to determine the distance H between the top plate 127 and the slurry mother liquid level m', or the distance H' between the top plate 127 and the pellet accumulation surface n'. Accordingly, when the slurry is charged, a slurry mother liquid discharge pump 136 is controlled so that the distance H between the top plate 127 and the slurry mother liquid level m' becomes almost constant. When the distance H' between the top plate 127 and the pellet accumulation surface n' reached a predetermined value, the charge of pellets is stopped.

On the other hand, as described above, the jet pump (ejector) 130 is positioned at the bottom parts 129*a* and 129*b* of the storage tank 16. The pellet discharge means including the jet pump 130 will be described below. For convenience, however, the description will be given to the pellet discharge means at the center of the bottom plate, and detail description about other pellet discharge means will not be given here applying the same reference symbol to the same component.

Figure 6:
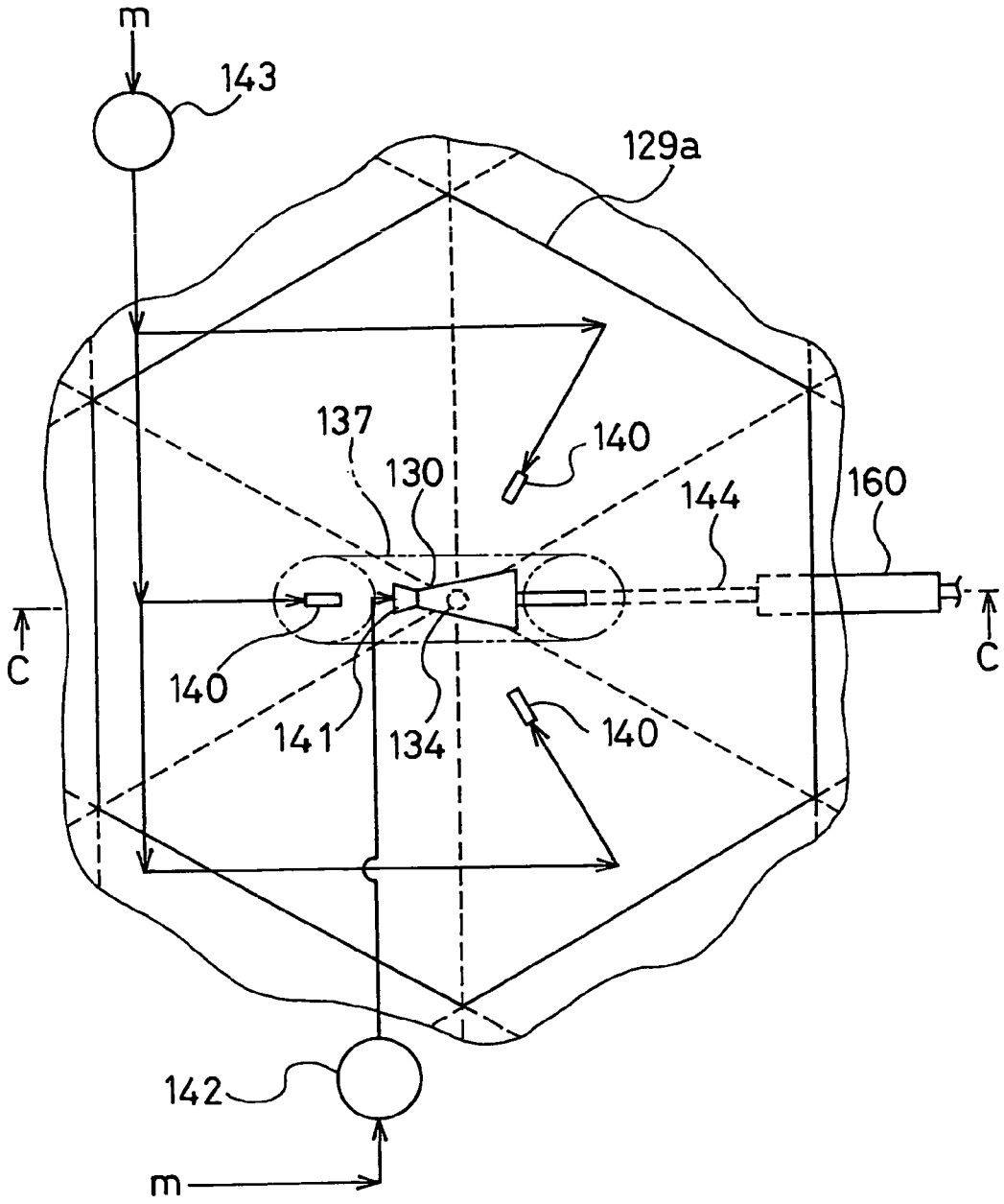
FIG. 6 shows a main part-enlarged plan view of the bottom part of the storage tank.
Figure 7:
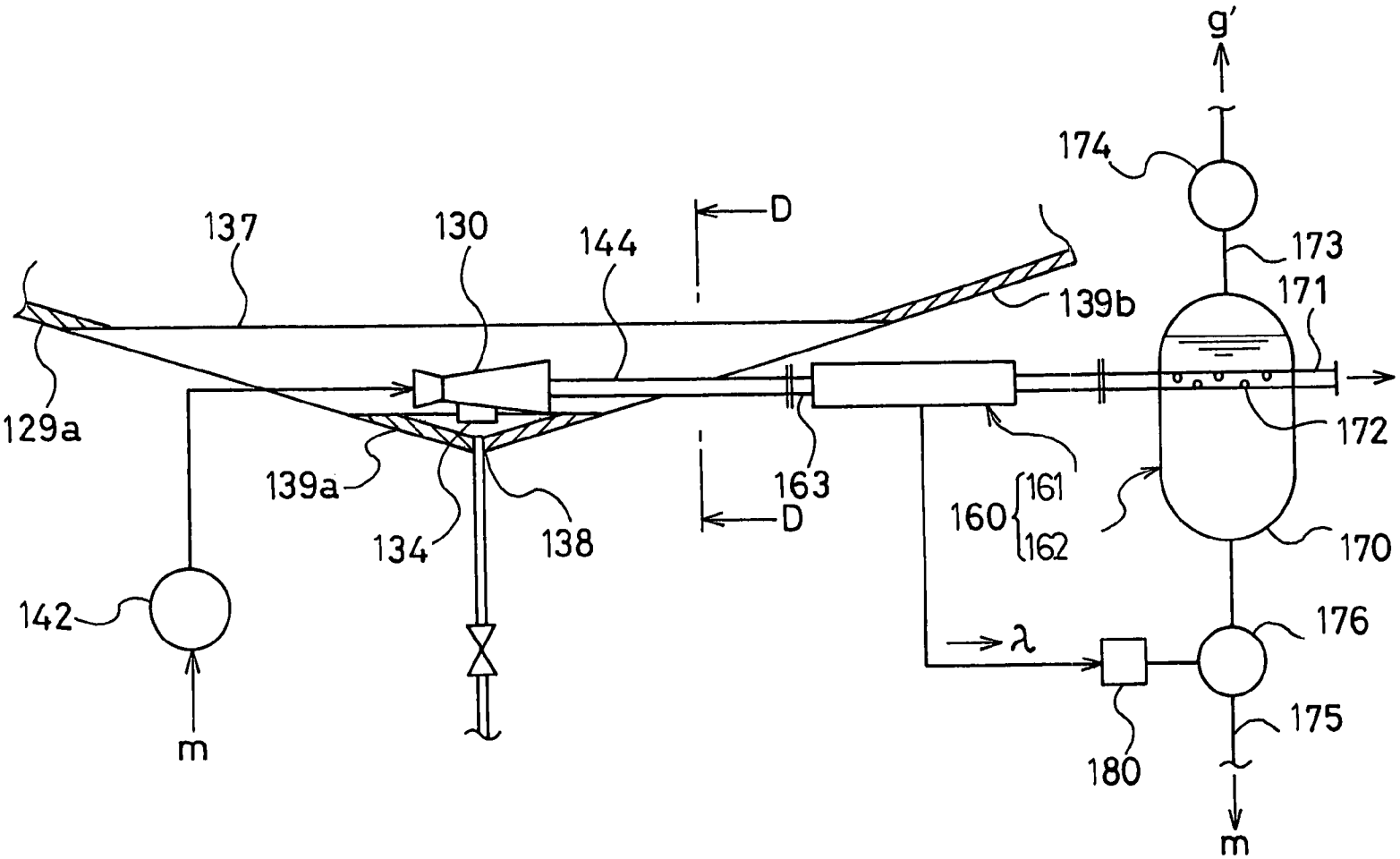
FIG. 7 shows a cross-sectional view of FIG. 6 along the line C-C.
Figure 8:
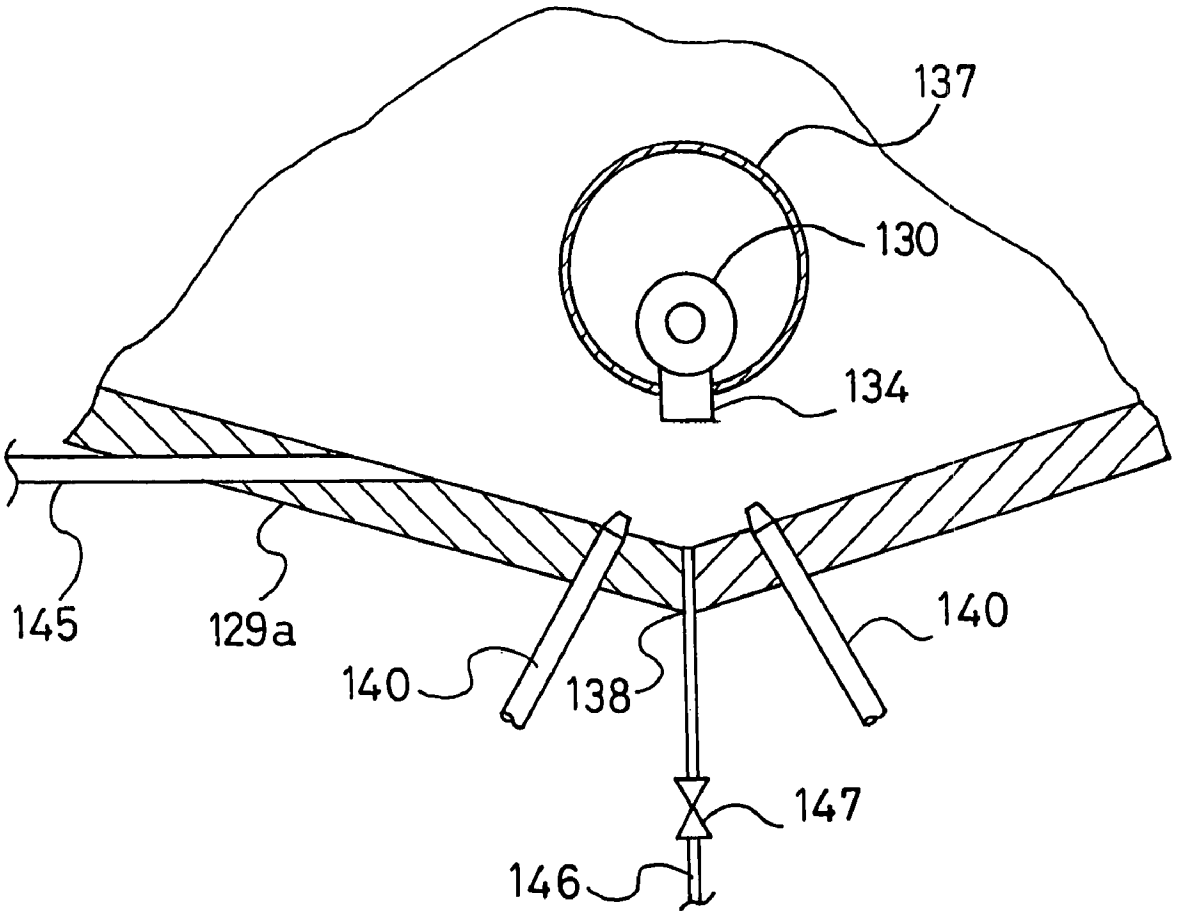
FIG. 8 shows a cross-sectional view of FIG. 7 along the line D-D.

As shown in FIG. 6, a tunnel 137 for inspection is located at the hexagonal pyramid-shape bottom part 129*a* at center of the bottom plate. The inspection tunnel 137 is, as shown in FIG. 7, positioned at above an apical part 138 of the hexagonal pyramid shape bottom part 129*a*, and both ends of the tunnel 137 open on slopes 139*a* and 139*b* of the bottom part 129*a*, respectively. As shown in FIGS. 7 and 8, the tunnel 137 has the built-in jet pump (ejector) 130. A suction opening 134 of the jet pump 130 directs the apical part 138 of the hexagonal pyramid shape bottom part 129*a*. As shown in FIG. 6, on the hexagonal pyramid shape bottom part 129*a*, pluralities, (for example, three), of high-pressure ejection nozzles 140 are positioned directing the suction opening 134 of the jet pump 130, to bring the pellets in the vicinity of the suction opening into a flowing state.

The slurry mother liquid m in the slurry mother liquid storage tank 14 is supplied to a working fluid intake 141 of the jet pump 130 by a jet fluid driving pump 142, and further is supplied to the high-pressure ejection nozzle 140 by a high-pressure pump 143 for nozzle. Furthermore, to a pipe 144 connected to the discharge side of the jet pump 130, a slurry concentration controller 160 (hereinafter referred to as the "IPF controller") is mounted. The IPF controller 160 is structured by an IPF-measuring device 161 and a slurry concentration-adjusting tank 162.

Figure 10:
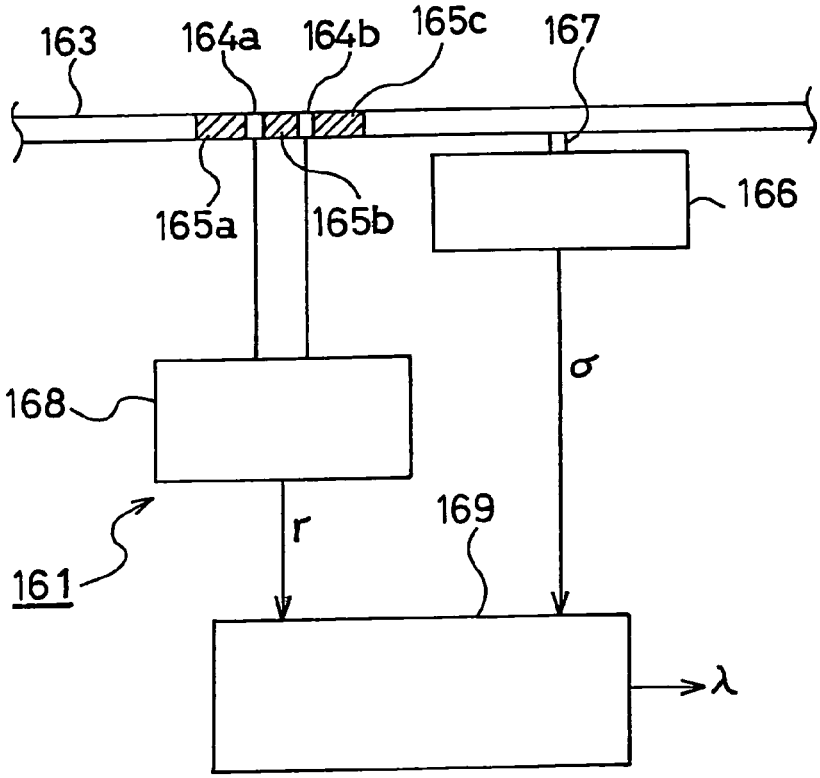
FIG. 10 shows an illustration of the IPF measuring device.

As shown in FIG. 10, the IPF measuring device 161 arranges a pair of ring-shape electrodes 164*a* and 164*b* on an instrumentation pipe 163 being inserted in the pipe 144, via three insulation rings 165*a*, 165*b*, and 165*c*, keeping distance in the axial direction from each other. At measuring point at the upstream side or the downstream side of the ring-shape electrodes 165*a* and 165*b* on the instrumentation pipe 163, an electric conductivity-measuring device 166 is connected via a thin intake pipe 167. Only the slurry mother liquid as the conductive fluid enters into the electric conductivity-measuring device 166. In addition, the electric conductivity-measuring device 166 has a pair of electrodes (not shown) therein.

An electric resistance-measuring device 168 measures the resistance between the pair of ring-shape electrodes 164*a* and 164*b*, or measures the electric resistance of a mixed-phase fluid (slurry containing pellets) passing through the instrumentation pipe 163, On the other hand, the electric conductivity-measuring device 166 measures the electric resistance (proportional to reciprocal number of electric conductivity σ) of the slurry mother liquid as a component of the mixed-phase fluid based on the resistance between the pair of electrodes positioned in the electric conductivity-measuring device 166. Thus measured electric resistance r and electric conductivity σ are inputted to a computing unit 169. The computing unit 169 stores the relation between the electric resistance r and the mixing rate λ at each electric conductivity σ of the slurry mother liquid. When the electric resistance r and the electric conductivity σ are inputted, the mixing rate λ corresponding to the inputted values is computed, and is outputted as the measured value.

On the other hand, the slurry concentration-adjusting tank 162 is positioned at the downstream side of the IPF-measuring device 161, and is structured by a liquid-holding tank 170 and a penetration pipe 171 penetrating therethrough. The penetration pipe 171 is connected with the instrumentation pipe 163 of the IPF-measuring device, and has a small hole 172 at a portion of the penetration pipe 171 inside the liquid-holding tank 170, through which hole 172, gas and the slurry mother liquid flow out. A blower 174 is installed to be connected with a pipe 173 connected with the upper end of the liquid-holding tank 170, to return the non-reacted gas g' in the liquid-holding tank 170 to the storage tank 16. In addition, a slurry concentration-adjusting pump 176 is installed to be connected with a pipe 175 connected with the lower end of the liquid-holding tank 170, which thus returns the slurry mother liquid m in the liquid-holding tank 170 to the storage tank 16.

The mixing rate λ outputted from the IPF-measuring device 161 enters a controller 180 to control the slurry concentration-adjusting pump 176 attached to the slurry concentration-adjusting tank 162, thus to remove excess slurry mother liquid m.

Figure 9:
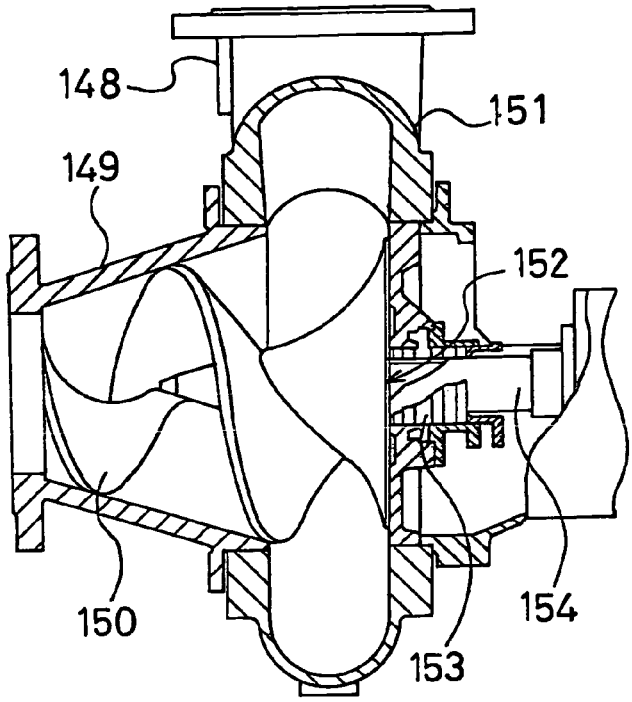
FIG. 9 shows a cross-sectional view of the pellet transfer pump.

Referring again to FIG. 8, at the hexagonal pyramid-shape bottom part 129*a*, there are provided a slurry mother liquid charge pipe 145 and a slurry mother liquid discharge pipe 146. By controlling the slurry mother liquid discharge pump 136 (refer to FIG. 4) installed on the slurry mother liquid discharge pipe 146 by the distance-measuring device 135, the slurry mother liquid level m' in the storage tank 16 is controlled. The slurry mother liquid discharge pipe 146 has a valve 147. The second slurry transfer pipe 19 has a slurry transfer pump 148 (refer to FIG. 4). The slurry transfer pump 148 has a structure to allow the suppression of the damage of pellets p. As shown in FIG. 9, there is provided a spiral-shape impeller 150 in a suction cover 149. The reference number 151 signifies a casing, 152 signifies an impeller flange, 153 signifies a shaft sleeve, and 154 signifies a main shaft.

(4) Next, the method for carrying out the pellets p, molded in the granulation apparatus 9 through the use of the slurry mother liquid m will be described.

Figure 11:
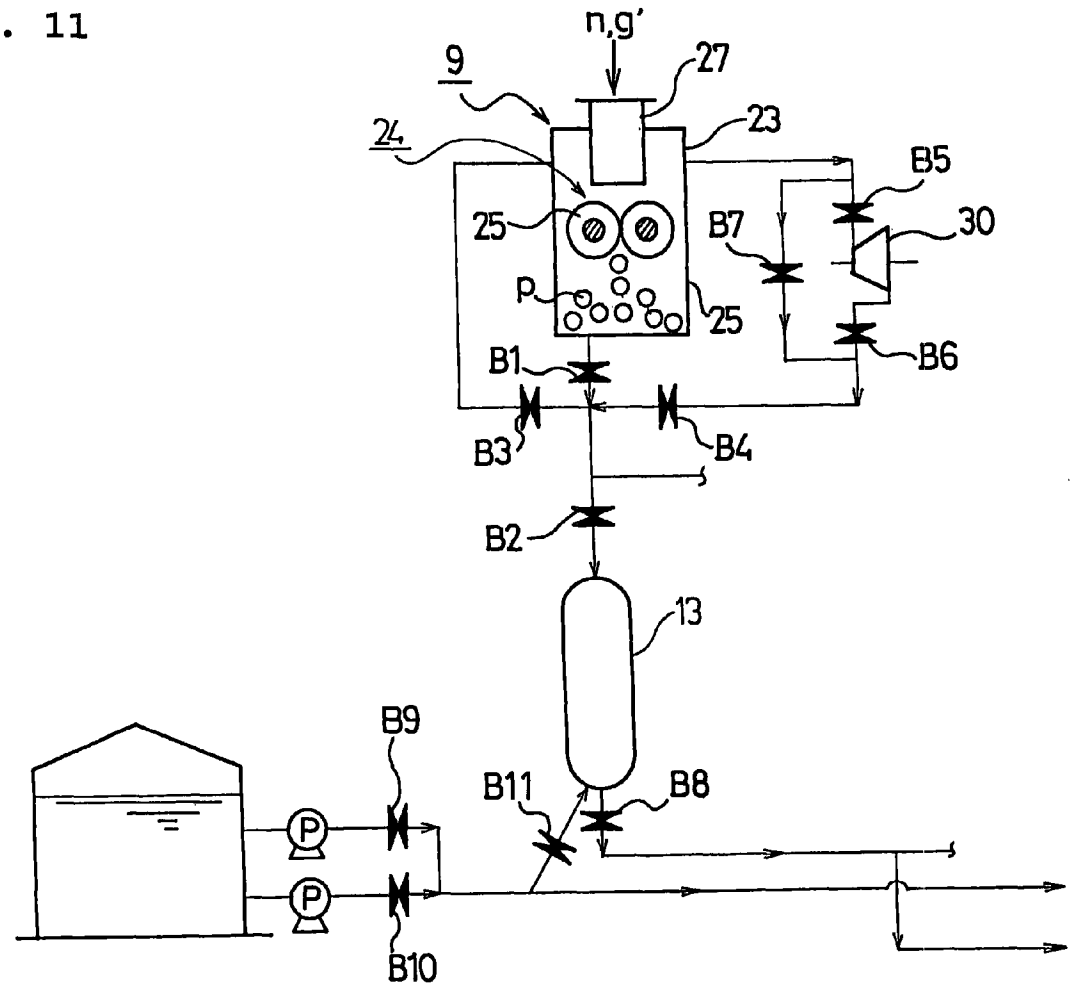
FIG. 11 shows an illustration of the gas hydrate carry-out apparatus at start.

(a) When the powdery gas hydrate n is supplied to the granulation apparatus 9 via the gas hydrate introducing pipe 27, as shown in FIG. 11, the granulator 24 having two granulation circular discs 25 molds near-spherical pellets p. At that moment, a part of the non-reacted gas g' under high pressure (for example, 5.4 MPa) in the gas hydrate production apparatus flows into the pressure vessel 23 of the granulation apparatus 9 together with the gas hydrate n. In addition, all the valves of first to eleventh, B1 to B11, are closed in that state.

Figure 12:
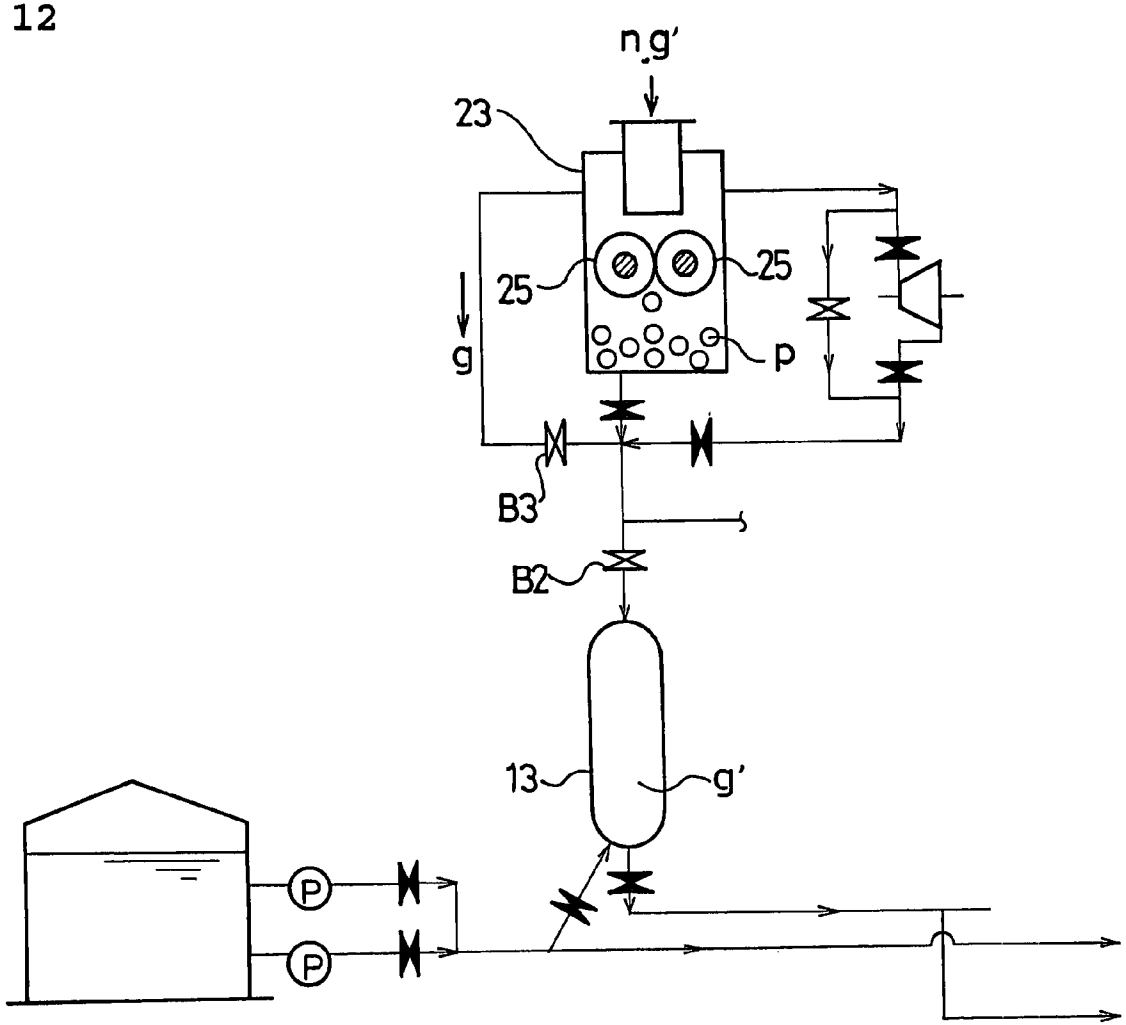
FIG. 12 shows an illustration of the charge of non-reacted gas under pressure into the slurry tank.

(b) Next, as shown in FIG. 12, only the second valve B2 and the third valve B3 are opened to charge the non-reacted gas g' in the pressure vessel 23 under a positive pressure into the slurry tank 13. After charging under pressure, only the third valve B3 is closed.

Figure 13:
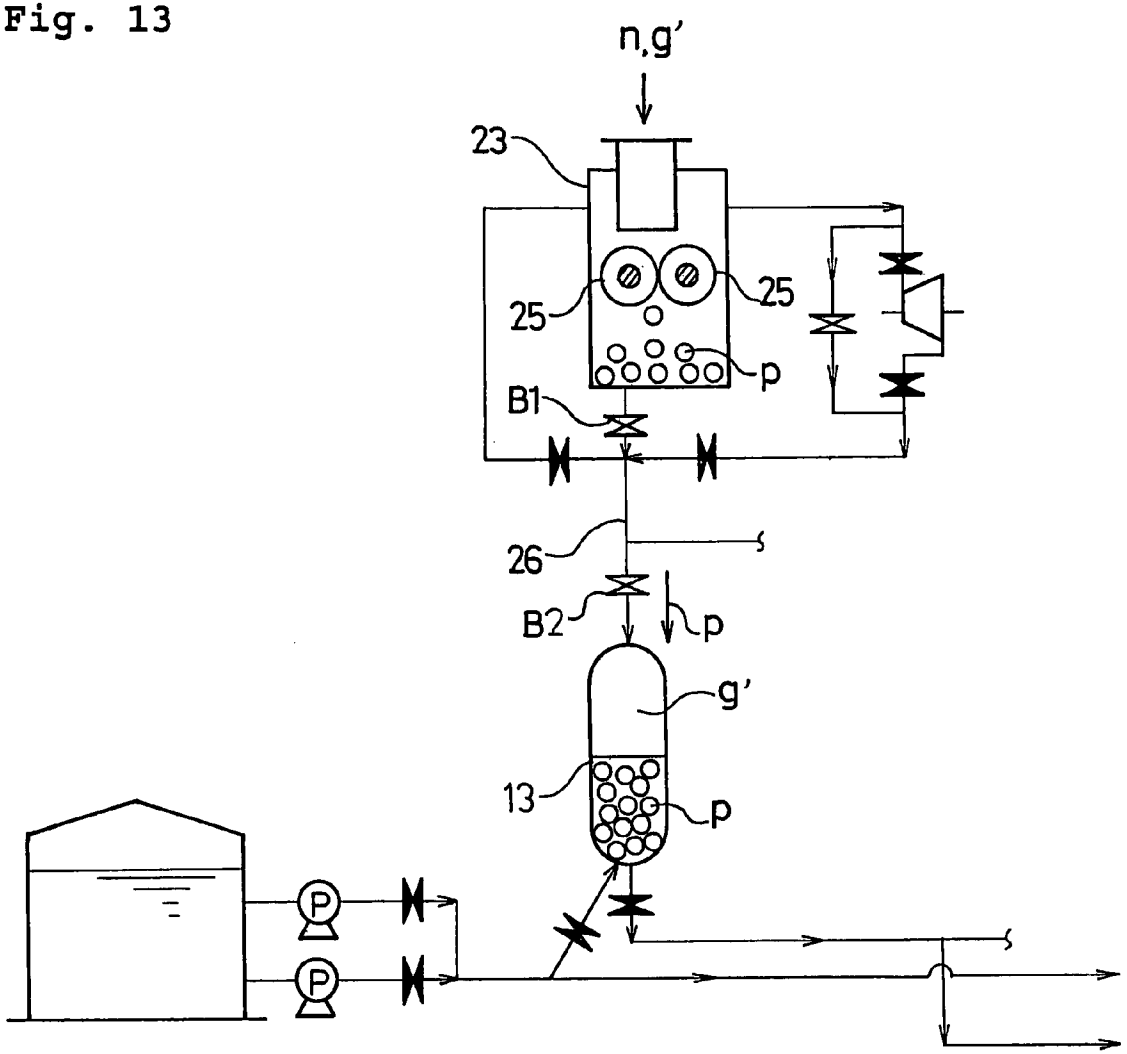
FIG. 13 shows an illustration of the charge of pellets into the slurry tank.

(c) Then, as shown in FIG. 13, only the first valve B1 is opened to charge the pellets p in the pressure vessel 23 into the slurry tank 13 via the pellet supply pipe 26. After charging the pellets, the first valve B1 is closed.

Figure 14:
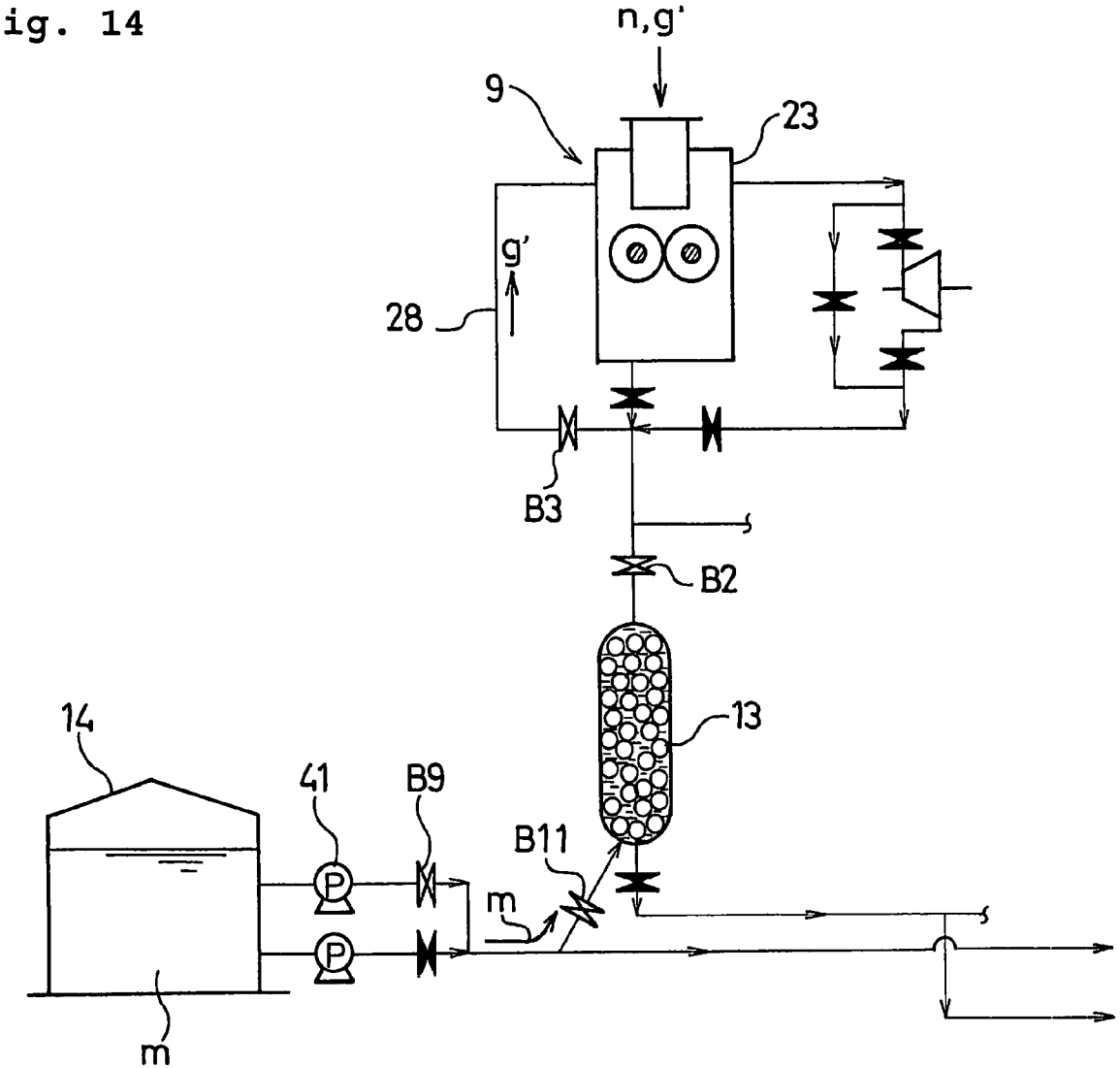
FIG. 14 shows an illustration of the return of non-reacted gas to the granulation apparatus.

(d) Then, as shown in FIG. 14, the second valve B2, the third valve B3, the ninth valve B9, and the eleventh valve B11 are opened. After that, the high pressure pump 41 is started to increase the pressure of the slurry mother liquid m in the slurry mother liquid storage tank 14 to a specified level (for example, 5.4 MPa or above), to charge the slurry mother liquid m under pressure into the slurry tank 13, and to return the non-reacted gas g' in the slurry tank 13 to the pressure vessel 23 of the granulation apparatus 9 via the gas-returning pipe 28. Then, the second valve B2, the third valve B3, the ninth valve B9, and the eleventh valve B11 are closed.

Figure 15:
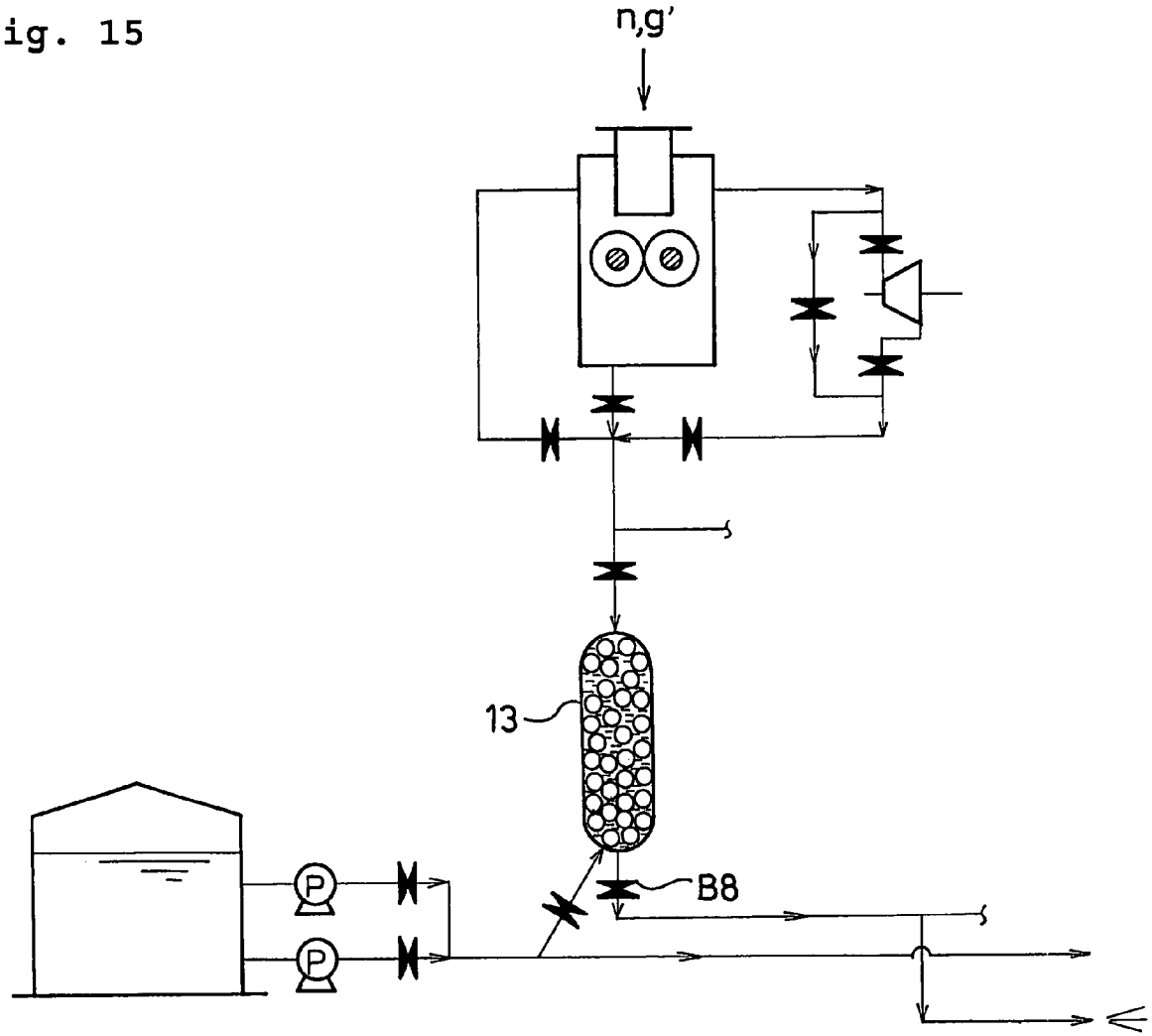
FIG. 15 shows an illustration of the release of internal pressure of the slurry tank.

(e) Then, as shown in FIG. 15, the eighth valve B8 is opened and closed instantaneously or in a short period of time (for example, opened and closed for 0.1 to 1.0 second), to release the internal pressure of the slurry tank 13 (for example, 5.4 MPa→0.1 MPa).

Figure 16:
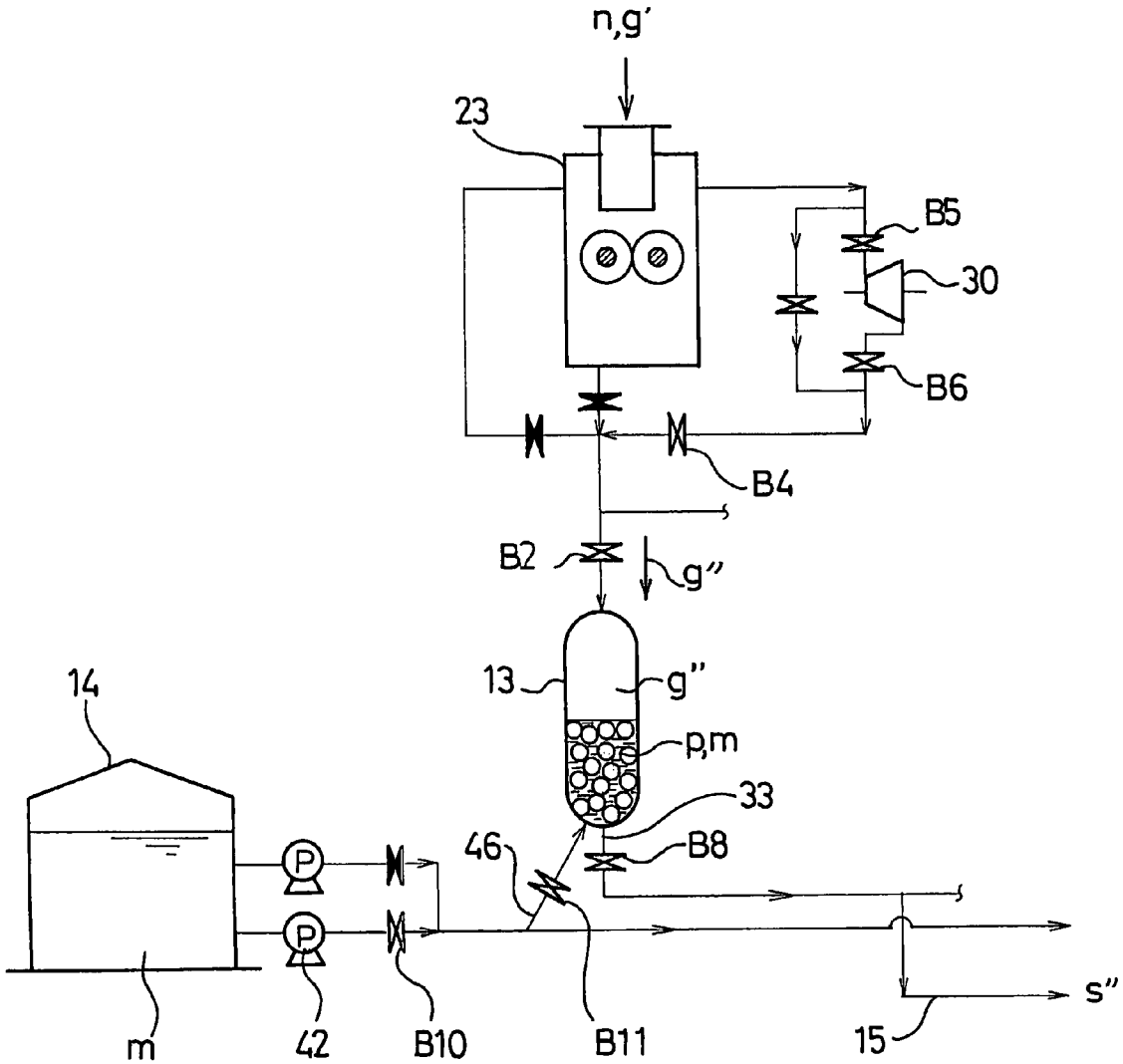
FIG. 16 shows an illustration of the push-out of slurry from the slurry tank.

(f) Then, as shown in FIG. 16, when the second valve B2, the fourth to sixth valves B4 to B6, and the eighth valve B8 are opened, the non-reacted gas g" which is depressurized to a specified level (for example, about 0.4 MPa) by the pressure reducer 30 is charged from the pressure vessel 23 into the slurry tank 13, and the pellets p in the slurry tank 13 are pushed out into the slurry transfer pipe 15 together with the slurry mother liquid m.

At that moment, the low-pressure pump 42 increases the pressure of the slurry mother liquid m in the slurry mother liquid storage tank 14 to a specified level (for example, 0.4 MPa) to charge the slurry mother liquid m from the branch pipe 46 near the inlet of the slurry discharge pipe 33 at the bottom part of the slurry tank 13, and to adjust the concentration of the slurry s" which is pushed out from the slurry tank 13 to be about 30%. At that moment, the tenth valve B10 and the eleventh valve B11 are opened. At the moment of discharging the slurry s" from the slurry tank 13, the second valve B2, the fourth to the sixth valves B4 to B6, the eighth valve B8, the tenth valve B10, and the eleventh valve B11 are closed.

Figure 17:
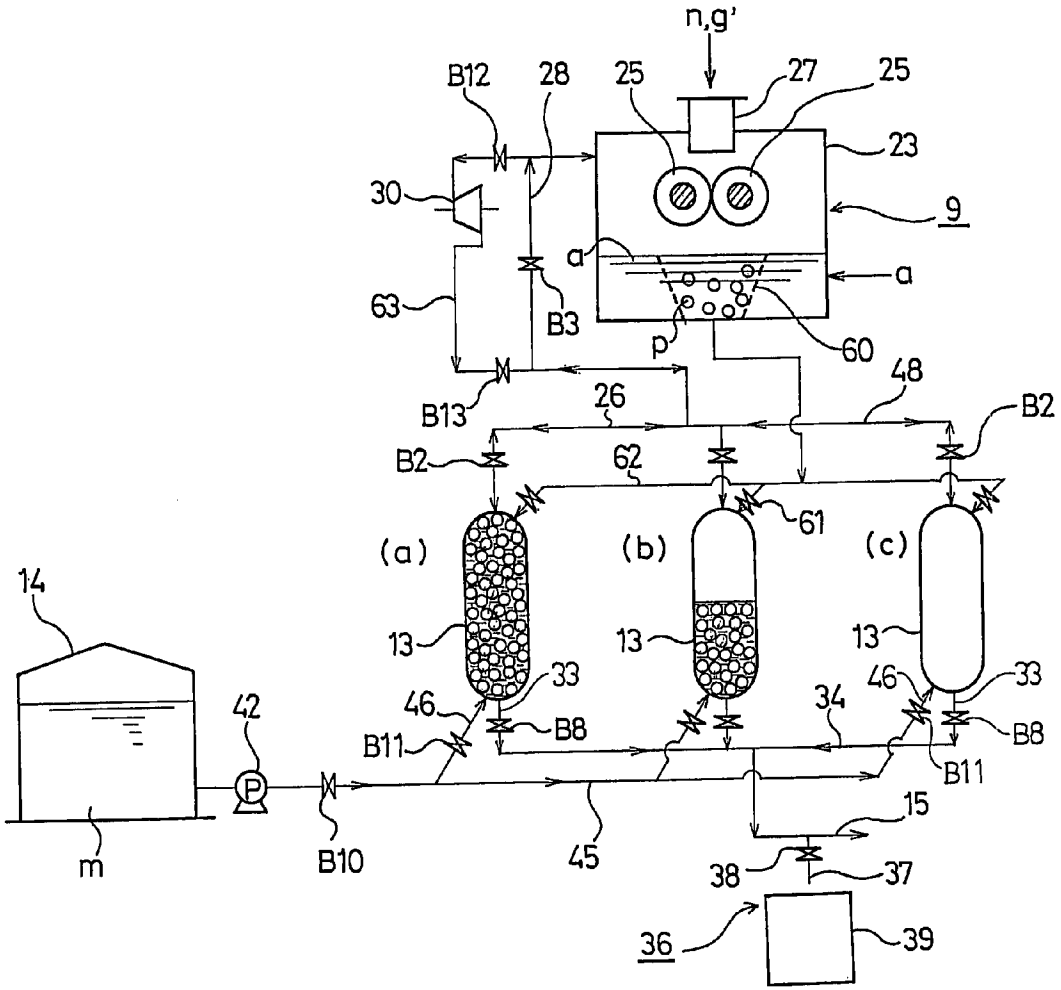
FIG. 17 shows a rough structure of another example of the method for carrying out gas hydrate according to the present invention.

(5) Next, the second pellet carrying-out apparatus will be described referring to FIG. 17.

This example is limited to the case that the pellet-cooling liquid a in the pressure vessel 23 can be used as the slurry mother liquid. Since, however, the structure resembles that of the first pellet carrying-out apparatus, the same parts have the same reference numbers, and detail description thereof will not be given here.

In this example, however, the second pellet carrying-out apparatus is different from the first pellet carrying-out apparatus in that a funnel 60 made of a perforated plate is provided in the pressure vessel 23 to prevent spread of pellets p, a pellet supply pipe 62 equipped with a valve 61 is mounted, a bypass pipe 63 is provided at the outer side of the gas-returning pipe 28 with the third valve B3, and the bypass pipe 63 has the pressure reducer 30, the twelfth valve B12, and the thirteenth valve B13.

The operational procedure of the apparatus will be described below.

(a) First, the third valve B3 in the gas-returning pipe 28 of the granulation apparatus 9 and the valve 61 of the pellet supply pipe 62 are opened to charge the slurry s" into the slurry tank 13 from the granulation apparatus 9. With the progress of the charging, the non-reacted gas g' in the slurry tank 13 returns to the pressure vessel 23 of the granulation apparatus 9 via the gas-returning pipe 28.

After the slurry tank 13 is filled with the slurry s", the valve B3 of the gas-returning pipe 28 is closed. Then, the valve B8 of the slurry discharge pipe 33 connected to the bottom part of the slurry tank 13 is opened and closed for a short period of time to release the internal pressure of the slurry tank 13.

(b) Next, the valves B12 and B13 of the bypass pipe 63 are opened. Furthermore, the valve B2 of the pellet supply pipe 26 is opened to charge the depressurized (for example, 0.4 MPa) non-reacted gas g' from the pressure vessel 23 of the granulation apparatus 9 into the slurry tank 13 to push out the slurry s" in the slurry tank 13 into the first slurry transfer pipe 15. At that moment, the low-pressure pump 42 is started to increase the pressure of the slurry mother liquid m in the slurry mother liquid storage tank 14 to a specified level (for example, 0.4 MPa) to charge the slurry mother liquid m near the inlet of the slurry discharge pipe 33 at the bottom part of the slurry tank 13 via the branch pipe 46, and to adjust the concentration of the slurry s" which is pushed out from the slurry tank 13 to be about 30%.

(c) Then, at the moment that the slurry s" is discharged from the slurry tank 13, each valve is closed. After that, by opening the second valve B2 and the third valve B3, the slurry tank is again filled with high-pressure non-reacted gas g' (for example, about 5.4 MPa).

(6) Next, the method for storing and transporting pellets will be described.

The description will begin with the method for storing pellets p in the storage tank 16.

Figure 18:
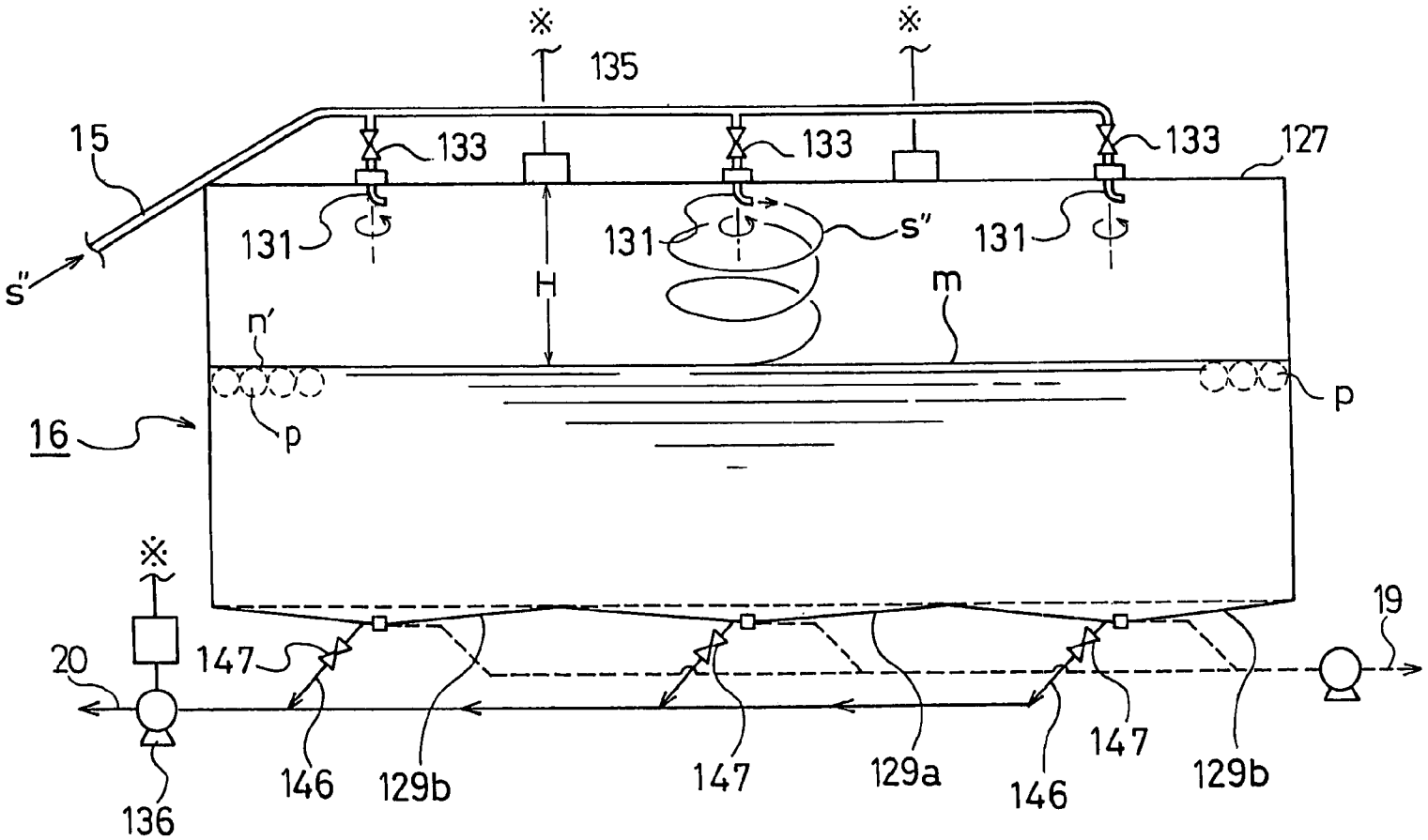
FIG. 18 shows an illustration of a method for storing pellets.

(a) First, as shown in FIG. 18, the slurry mother liquid discharge valves 147 of the respective slurry mother liquid discharge pipes 146 connected to the tank bottom parts 129*a* and 129*b* of the storage tank 16 are fully opened.

(b) Then, the valves 133 at top of the storage tank are fully opened to fill the storage tank 16 with the slurry mother liquid m (refer to FIG. 18). In that regard, the level of slurry mother liquid m is adjusted to the extent that pellets charged from the slurry-charging nozzles 131 are not damaged (for example, the level is kept apart from the top plate 17 of the storage tank by a distance of H). At this time, the slurry mother liquid m takes the route of: the slurry mother liquid storage tank 14→the pressurizing pump 22→the slurry mother liquid transfer pipe 15→the storage tank 16 (refer to FIG. 1).

(c) Then, the valves 133 at top of the storage tank are once fully closed. After that, the valves 133 are opened to charge the slurry s" into the storage tank 16, (refer to FIG. 18). In that regard, the valves 133 are opened one by one, for example in sequential order from 133*a*, 133*b*, 133*c*, 133*d*, 133*e*, 133*f*, to 133*g*, (refer to FIG. 3), which equalizes the charge amount of slurry s" through each valve 133.

Since each of slurry charge nozzles 131 has a structure of freely rotating horizontally in 360°, as described before, the slurry charge nozzle 131 ejects the slurry s" horizontally at a specified initial velocity while rotating the nozzle by itself. Since the slurry s" immediately after the ejection requires a large falling distance, the slurry s" is distributed on the broad circumference of circle. With the progress of the charge of pellets, the slurry is gradually distributed on the narrow circumference of circle, and flattens the upper surface of the accumulated pellets.

(d) At the same time with the beginning of slurry charge, the slurry mother liquid discharge valve 147 of each of the storage tank bottoms 129*a* and 129*b* is fully opened and discharges successively the slurry mother liquid m while leaving behind the amount of shock-absorbing slurry mother liquid at the top of the accumulated pellets. In this state, the slurry mother liquid m takes the route of: the slurry mother liquid discharge pipe 146→the slurry mother liquid discharge valve 147→the slurry mother liquid discharge pump 136→the slurry mother liquid storage tank 14. After completing the charge of slurry, the level of the slurry mother liquid m is lowered to a level which gives equivalent height for both the pellet accumulation level n' and the slurry mother liquid m level, to store the pellets.

(7) Next is the description about the method for transporting the pellets p in the storage tank 16.

Figure 19:
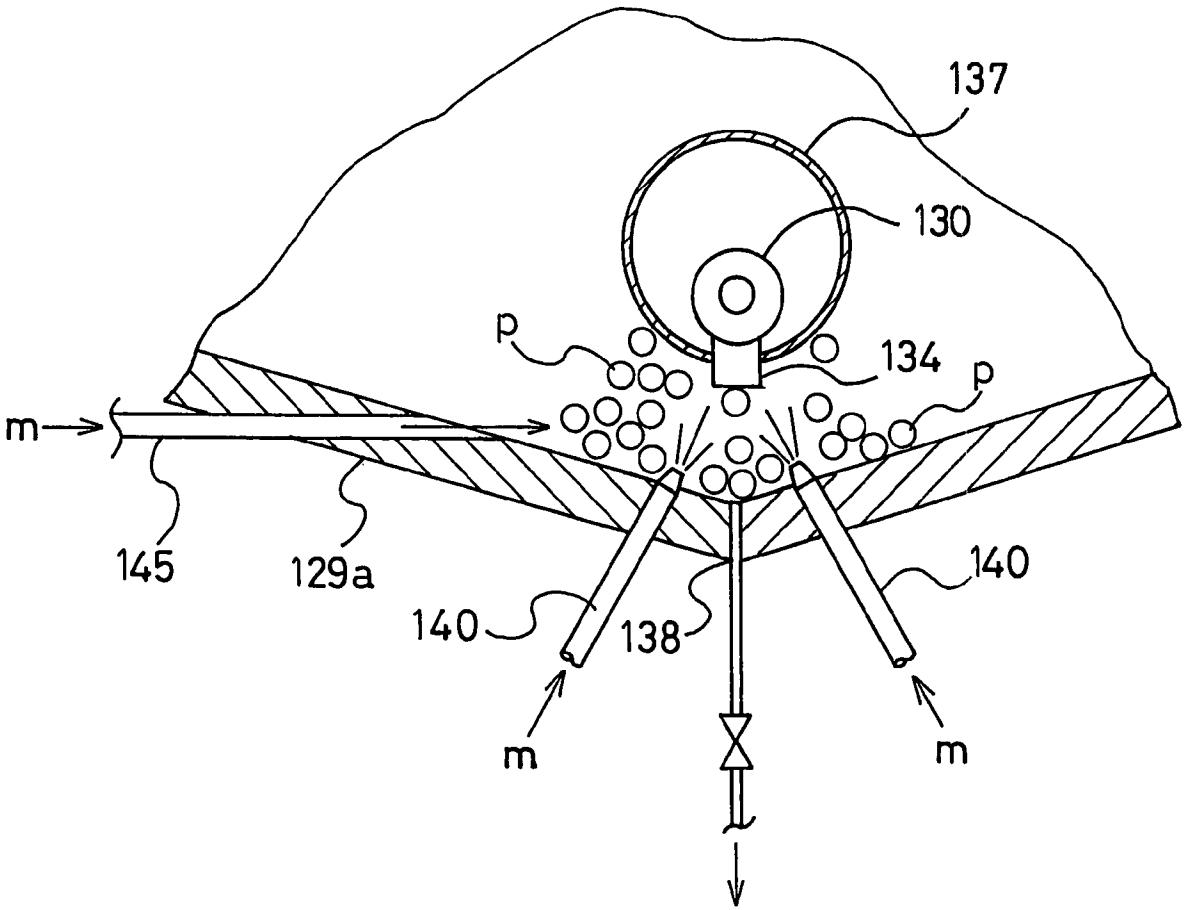
FIG. 19 shows an illustration of a method for transporting pellets.

(a) First, as shown in FIG. 19, the slurry mother liquid m is ejected from pluralities (for example, three) of the high-pressure ejection nozzles 140 attached to each of the tank bottom parts 129*a* and 129*b* to break up a lump of pellets p packed in the vicinity of the suction opening 134 of the jet pump 130. In this state, the slurry mother liquid m takes the route of: the slurry mother liquid storage tank 14→the high pressure pump 143 for nozzle→the high pressure ejection nozzle 140.

Figure 20:
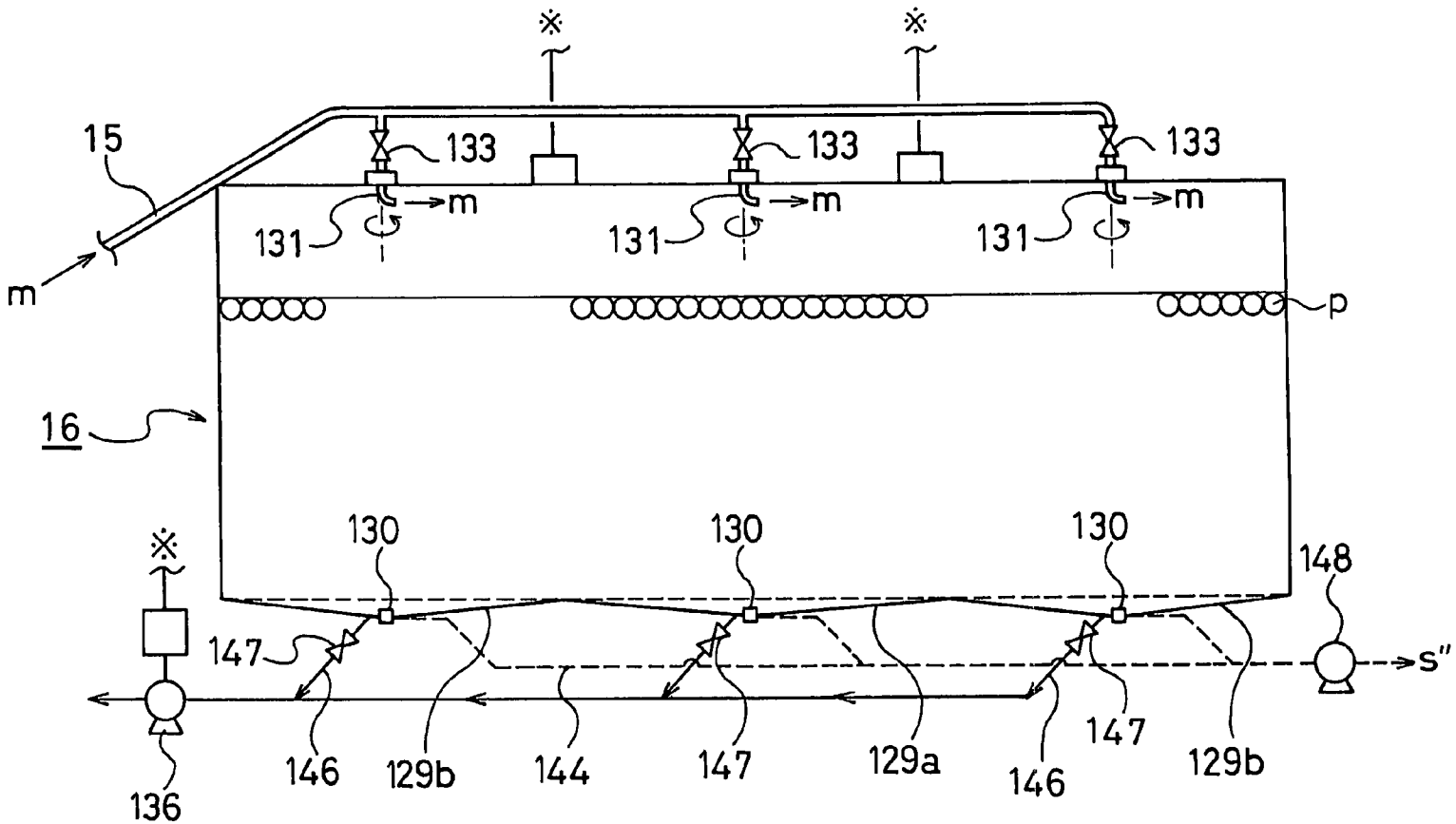
FIG. 20 shows an illustration of a method for transporting pellets.

(b) Then, as shown in FIG. 20, the slurry mother liquid m is ejected from the slurry charge nozzle 131 at the upper part of the storage tank in order to prepare the slurry volume concentration of 30%. In this state, the slurry mother liquid takes the route of: the slurry mother liquid storage tank 14→the pressurizing pump 22→the slurry charge nozzle 131.

(c) Then, the slurry mother liquid m is ejected from the slurry mother liquid charge pipes 145 at each of the bottom parts 129*a* and 129*b* in order to prepare the slurry volume concentration of 30% (refer to FIG. 19). In this state, the slurry mother liquid m takes the route of: the slurry mother liquid storage tank 14→the pressurizing pump 22→the slurry mother liquid charge pipe 145.

(d) Then, the jet pump 130 for discharging the pellets is started to suck the pellets p in the storage tank 16, and to charge the pellets into the pipe 144 under pressure. In this state, the slurry mother liquid m takes the route of: the slurry mother liquid storage tank 14→the jet fluid-driving pump 142→the jet pump 130.

(e) Then, the IPF controller 160 is actuated to charge the slurry s" into the slurry concentration-adjusting tank 162, and to adjust the concentration of the slurry to be about 30%.

(f) Then, the pellet slurry transfer pump 148 is started to transfer the slurry s" to the transport ship 17. In this state, the slurry s" takes the route of: the jet pump 130→the slurry transfer pump 148→the pellet loader→the hold 18 of the transport ship.

INDUSTRIAL APPLICABILITY

The present invention can be applied in wide fields of production, storage, and transportation of gas hydrate other than natural gas hydrate.

What is claimed is:

1. A method for producing gas hydrate through molding a powdery gas hydrate into pellets thereof using a granulation apparatus in a non-reacted gas, which pellets then being carried out to a storage tank under atmospheric pressure, comprising the steps of: charging said non-reacted gas into a slurry tank; charging said pellets into the slurry tank filled with the non-reacted gas; charging a slurry mother liquid into the slurry tank holding the charged pellets to return the non-reacted gas in the slurry tank to said granulation apparatus; manipulating a valve of a slurry transfer pipe attached to said slurry tank to release internal pressure of the slurry tank; and charging the depressurized non-reacted gas into the slurry tank after releasing the internal pressure, pushing the pellets in the slurry tank into said slurry transfer pipe together with the slurry mother liquid, and simultaneously supplying the slurry mother liquid to said slurry tank to dilute the concentration of the slurry.

2. A method for producing gas hydrate through forming a powdery gas hydrate into pellets thereof using a granulation apparatus in a non-reacted gas, which pellets then being carried out to a storage tank under atmospheric pressure, comprising the steps of: charging said pellets into a slurry mother liquid in said non-reacted gas to form a slurry; charging said slurry into a slurry tank to return the non-reacted gas in the slurry tank to said granulation apparatus; manipulating a valve of a slurry transfer pipe attached to said slurry tank to release internal pressure of the slurry tank; and charging the depressurized non-reacted gas into the slurry tank after releasing the internal pressure, pushing the pellets in the slurry tank into said slurry transfer pipe together with the slurry mother liquid, and simultaneously supplying the slurry mother liquid to said slurry tank to dilute the concentration of the slurry.

3. A method for storing gas hydrate through carrying pellets formed by compression molding of a powdery gas hydrate into a storage tank through the use of a slurry mother liquid, comprising the steps of charging a shock-absorbing liquid in advance to said storage tank, and absorbing a shock on the pellets being charged to said storage tank by the shock-absorbing liquid, and locating pluralities of slurry-charging nozzles at the upper part of the storage tank, and ejecting the slurry mother liquid which contains pellets there through in sequential order beginning from a specified nozzle.

4. A method for storing gas hydrate through carrying pellets formed by compression molding of a powdery gas hydrate into a storage tank through the use of a slurry mother liquid, comprising the steps of charging a shock-absorbing liquid in advance to said storage tank, and absorbing a shock on the pellets being charged to said storage tank by the shock-absorbing liquid, and ejecting the slurry mother liquid which contains the pellets, in a spiral pattern, from a freely rotatable slurry-charging nozzle positioned at the upper part of the storage tank.

* * * * *